US008253767B2

(12) United States Patent
Ito et al.

(10) Patent No.: US 8,253,767 B2
(45) Date of Patent: Aug. 28, 2012

(54) LINE HEAD AND IMAGE FORMING APPARATUS

(75) Inventors: Etsuko Ito, Shiojiri (JP); Takeshi Sowa, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 358 days.

(21) Appl. No.: 12/639,830

(22) Filed: Dec. 16, 2009

(65) Prior Publication Data

US 2010/0214389 A1 Aug. 26, 2010

(30) Foreign Application Priority Data

Feb. 23, 2009 (JP) ..... 2009-039987

(51) Int. Cl.
*B41J 2/45* (2006.01)
*B41J 15/14* (2006.01)
*B41J 27/00* (2006.01)

(52) U.S. Cl. ..... 347/238; 347/244; 347/258

(58) Field of Classification Search ..... 347/230, 347/238, 241–244, 256–258
See application file for complete search history.

(56) References Cited

U.S. PATENT DOCUMENTS 5,023,442 A 6/1991 Taniguchi et al. ..... 250/208.1
6,330,017 B1 * 12/2001 Suzuki ..... 347/238
7,432,947 B2 * 10/2008 Yosuke ..... 347/244

FOREIGN PATENT DOCUMENTS

JP 02-004546 1/1990

* cited by examiner

*Primary Examiner* — Hai C Pham
(74) *Attorney, Agent, or Firm* — DLA Piper LLP (US)

(57) ABSTRACT

A line head includes first to third light-emitting elements arranged in a first direction; and an optical system that forms images by light emitted from the first to third light-emitting elements on an imaging surface to form images of the light-emitting elements, in which the first light-emitting element is arranged between the second light-emitting element and the third light-emitting element in the first direction; the optical system has a first lens surface that has refractive power and is arranged so as to satisfy a relation of H>0.5D, where H is a distance in the first direction between the geometrical centers of the images of the second and third light-emitting elements, and D is the maximum width in the first direction of a light passing region of the first lens surface through which light emitted from the second and third light-emitting elements passes; and, light emitted from the first and second light-emitting elements do not overlap with each other on a cross section of the first lens surface taken along the first direction so as to include an optical axis of the optical system.

6 Claims, 18 Drawing Sheets

LINE HEAD AND IMAGE FORMING APPARATUS

BACKGROUND

1. Technical Field

The present invention relates to a line head and an image forming apparatus.

2. Related Art

Electrophotographic image forming apparatuses such as copying machines or printers are provided with an exposure unit that performs an exposure process on an outer surface of a rotating photoconductor so as to form an electrostatic latent image thereon. As the exposure unit, a line head having a structure in which a plurality of light-emitting elements is arranged in the direction of the rotation axis of the photoconductor is known (for example, see JP-A-2-4546)

As the line head, for example, JP-A-2-4546 describes an optical information writer in which a plurality of LED array chips with a plurality of LEDs (light-emitting elements) is arranged in one direction.

In the optical information writer, the plurality of LEDs of each of the LED array chips is arranged in the direction of the rotation axis of the photoconductor. Convex lens elements (optical systems) are provided so as to correspond to the respective LED array chips. The convex lens elements forms an image by light emitted from the respective LEDs of each of the LED array chips.

In the line head described in JP-A-2-4546, due to the image-surface curvature of the convex lens element, the imaging capability of the convex lens element decreases as it becomes distant from the optical axis. On the surface of the photoconductor, a spot size of light from an LED that is located close to the optical axis of the convex lens element is different from a spot size of light from an LED that is located distant from the optical axis of the convex lens element. As a result, the concentration of the latent image formed on the surface of the photoconductor becomes uneven between a pixel, which is formed by light from the LED located close to the optical axis of the convex lens element, and a pixel, which is formed by light from the LED located distant from the optical axis of the convex lens element, whereby concentration unevenness occurs.

SUMMARY

An advantage of some aspects of the invention is that it provides a line head capable of performing a high-accuracy exposure process and an image forming apparatus capable of obtaining a high-quality image.

The above-described advantage is achieved by the following aspects and embodiments of the invention.

According to an aspect of the invention, there is provided a line head including: a first light-emitting element, a second light-emitting element, and a third light-emitting element that are arranged in a first direction; and an optical system that forms an image by light emitted from the first light-emitting element, an image by light emitted from the second light-emitting element, and an image by light emitted from the third light-emitting element on an imaging surface to form images of the light-emitting elements, wherein the first light-emitting element is arranged between the second light-emitting element and the third light-emitting element in the first direction; the optical system has a first lens surface that has refractive power and is arranged so as to satisfy the relationship below; and, light emitted from the first light-emitting element and light emitted from the second light-emitting element do not overlap with each other on a cross section of the first lens surface taken along the first direction so as to include an optical axis of the optical system, $$H>0.5D$$

where H is a distance in the first direction between the geometrical center of the image of the second light-emitting element and the geometrical center of the image of the third light-emitting element, imaged by the optical system; and D is the maximum width in the first direction of a region of the first lens surface through that light emitted from the second light-emitting element and light emitted from the third light-emitting element pass.

In an embodiment of the line head of the above aspect of the invention, light emitted from four or more light-emitting elements that include the first light-emitting element, the second light-emitting element, and the third light-emitting element and are arranged in the first direction may be imaged on the imaging surface by the optical system so that: the first light-emitting element is located at the position closest to the optical axis among the four or more light-emitting elements; the second light-emitting element is located on one side in the first direction at the position furthest from the optical axis among the four or more light-emitting elements; and the third light-emitting element is located on the other side of the second light-emitting element in the first direction at the position furthest from the optical axis among the four or more light-emitting elements.

In another embodiment of the line head of the above aspect of the invention, the optical system may have two or more lens surfaces having refractive power including the first lens surface; and the first lens surface may be positioned the closest to an image side among the two or more lens surfaces having refractive power.

In another embodiment of the line head of the above aspect of the invention, an aperture diaphragm may be provided between the second light-emitting element and the optical system; and the lens surface may be arranged so as to satisfy a relation of $L\mathbf{1}\cdot\tan\omega>2\cdot L\mathbf{2}\cdot\tan\mu$, where $\omega$ is an angle in the first direction between the principal ray of light emitted from the second light-emitting element and the optical axis; $\mu$ is an image-side aperture angle (half-angle) of the optical system; L1 is a distance between the aperture diaphragm and the first lens surface; and L2 is a distance between the first lens surface and the imaging surface.

In another embodiment of the line head of the above aspect of the invention, the aperture diaphragm may be provided on a front-side focal plane of the optical system.

In another embodiment of the line head of the above aspect of the invention, light emitted from two light-emitting elements that are arranged adjacent to each other in the first direction among the four or more light-emitting elements may not overlap with each other on a cross section of the first lens surface taken along the first direction so as to include the optical axis.

According to another aspect of the invention, there is provided an image forming apparatus including: a latent image carrier on which a latent image is formed; and a line head that performs exposure on the latent image carrier so as to form the latent image, the line head including: a first light-emitting element, a second light-emitting element, and a third light-emitting element that are arranged in a first direction; and an optical system that forms an image by light emitted from the first light-emitting element, an image by light emitted from the second light-emitting element, and an image by light emitted from the third light-emitting element on the latent image carrier to form a latent image; in which: the first light-emitting element is arranged between the second light-emitting element and the third light-emitting element in the first direction; the optical system has a first lens surface that has refractive power and is arranged so as to satisfy the relationship below; and, light emitted from the first light-emitting element and light emitted from the second light-emitting element do not overlap with each other on a cross section of the first lens surface taken along the first direction so as to include an optical axis of the optical system.

$$H>0.5D$$

where H is a distance in the first direction between the geometrical center of the image of the second light-emitting element and the geometrical center of the image of the third light-emitting element, imaged by the optical system; and D is the maximum width in the first direction of a region of the first lens surface through which light emitted from the second light-emitting element and the third light-emitting element pass.

According to the line head of the aspects and embodiments of the invention having the above-described configuration, it is possible to suppress unevenness in the spot size on a projection surface (light receiving surface) due to an image-surface curvature between light-emitting elements having different angles of view. Therefore, it is possible to form a high-quality latent image in which concentration unevenness is suppressed. As a result, the line head of the invention is able to realize a high-accuracy exposure process.

Moreover, according to the image forming apparatus of the aspect of the invention, by realizing the above-described high-accuracy exposure process, it is possible to obtain a high-quality image in which concentration unevenness is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a line head and an image forming apparatus according to preferred embodiments of the invention will be described in detail with reference to the accompanying drawings.

Figure 1:
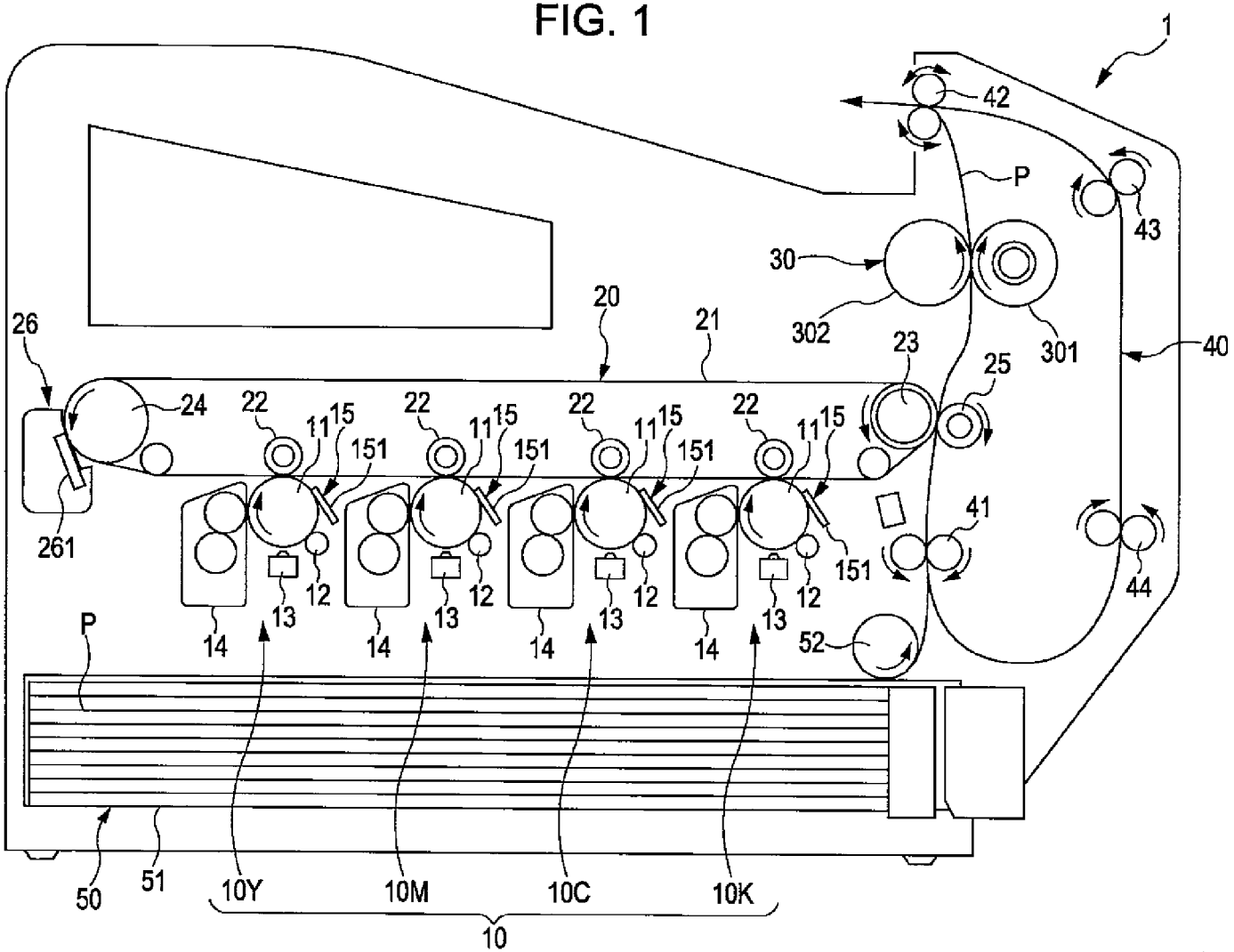
FIG. 1 is a schematic view illustrating the entire configuration of an image forming apparatus according to an embodiment of the invention.
Figure 2:
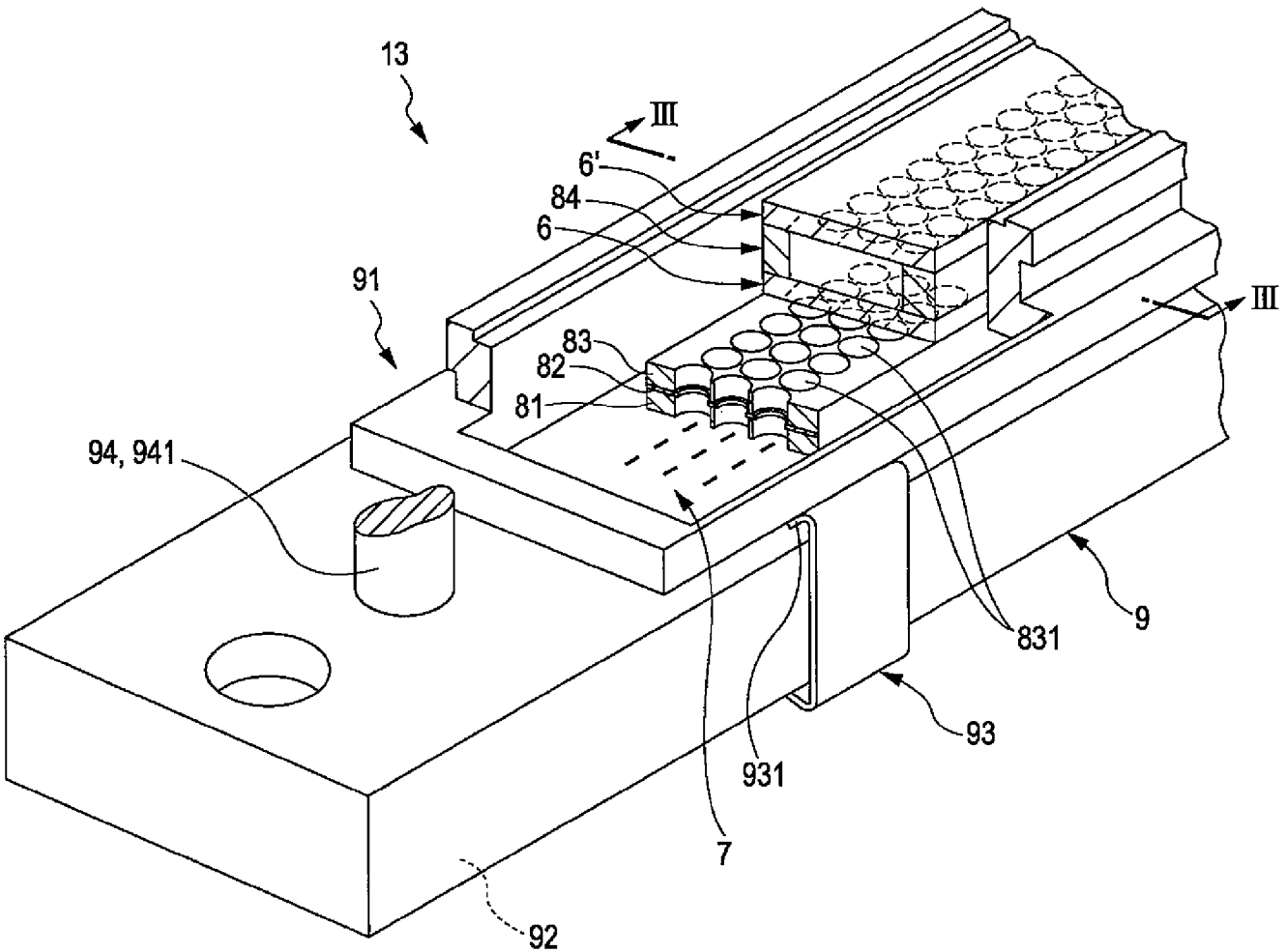
FIG. 2 is a partially sectional perspective view illustrating a line head included in the image forming apparatus illustrated in FIG. 1.
Figure 3:
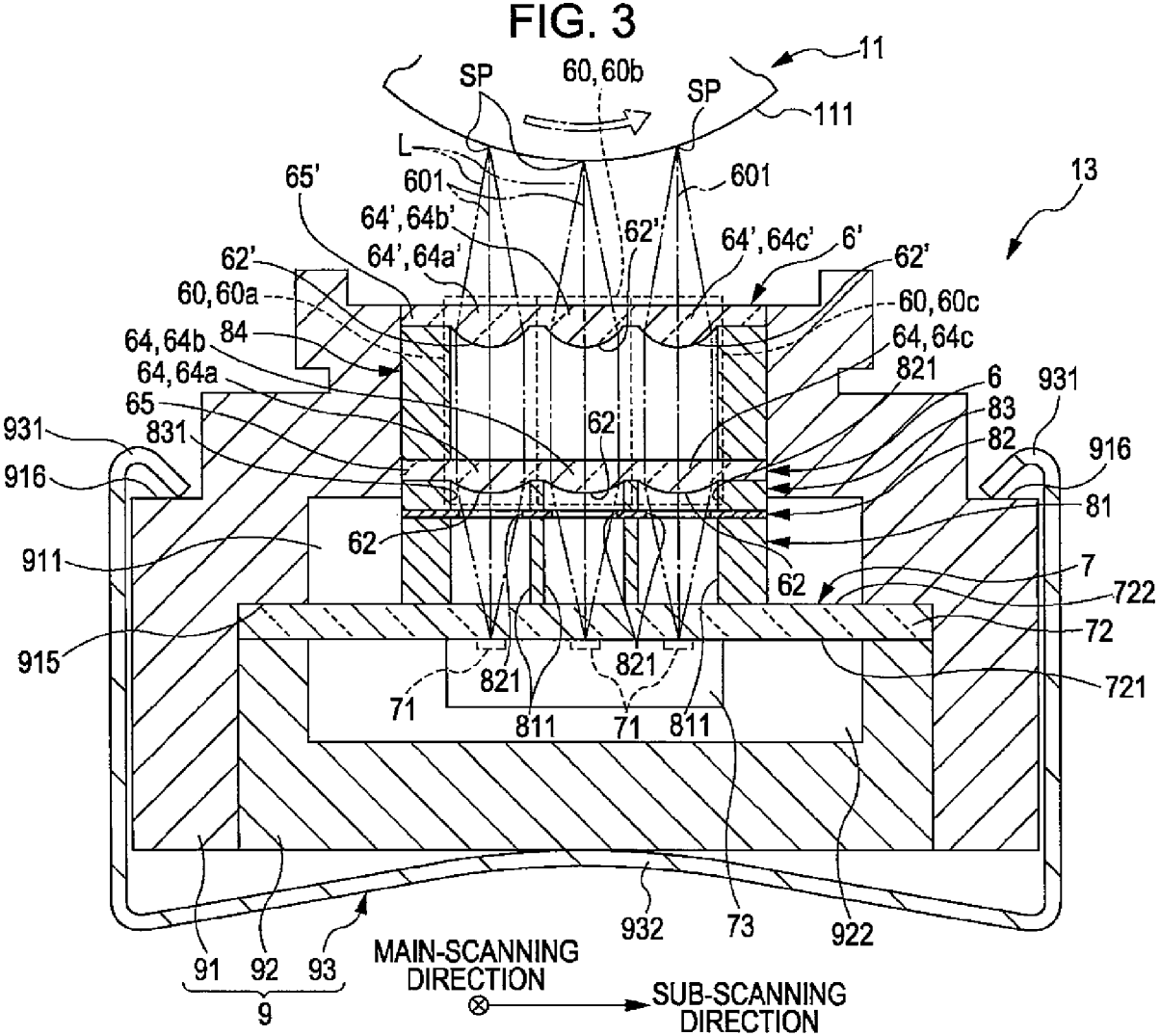
FIG. 3 is a cross-sectional view taken along the line III-III of FIG. 2.
Figure 4:
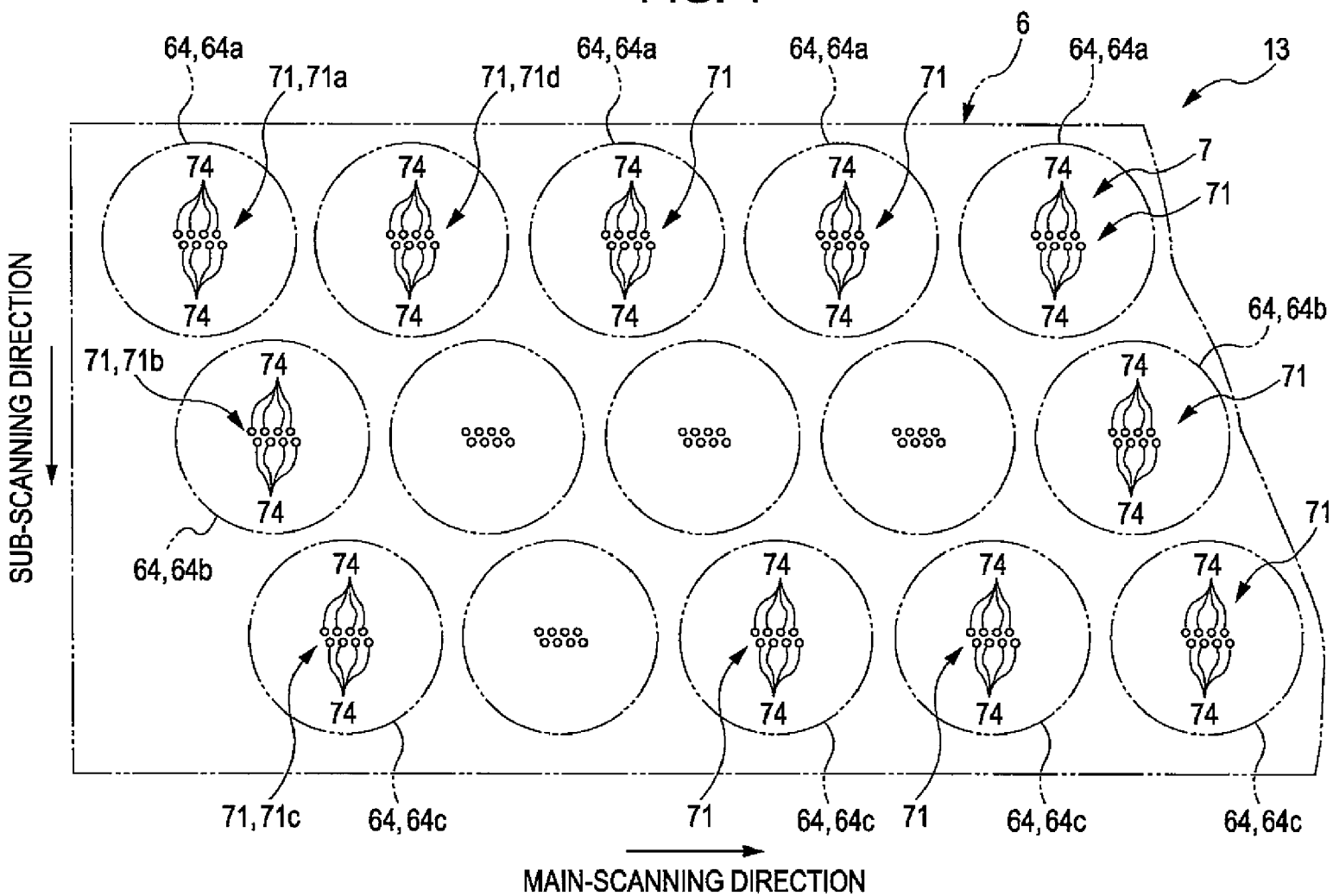
FIG. 4 is a plan view of the line head illustrated in FIG. 2.
Figure 5:
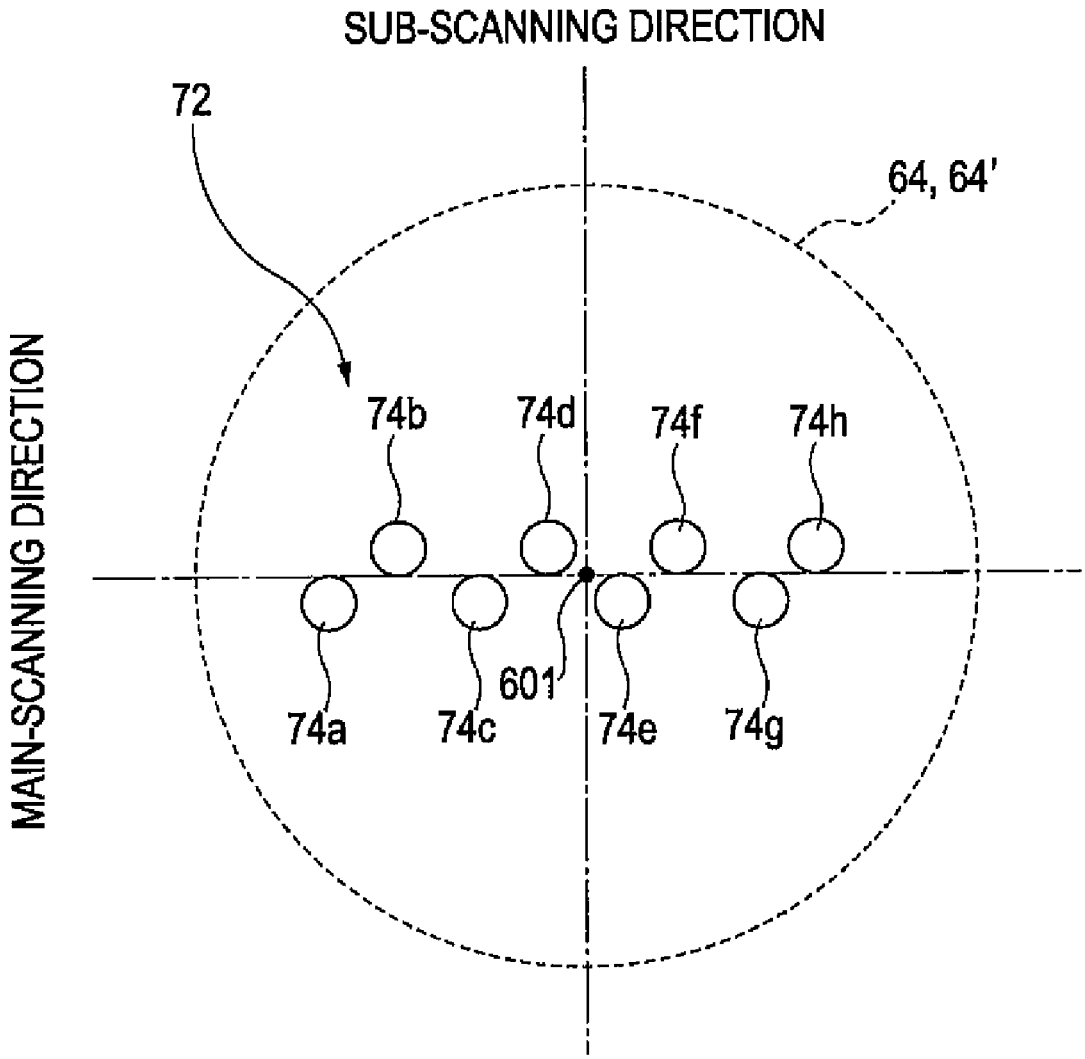
FIG. 5 is a plan view of a lens included in the line head illustrated in FIG. 2.
Figure 6:
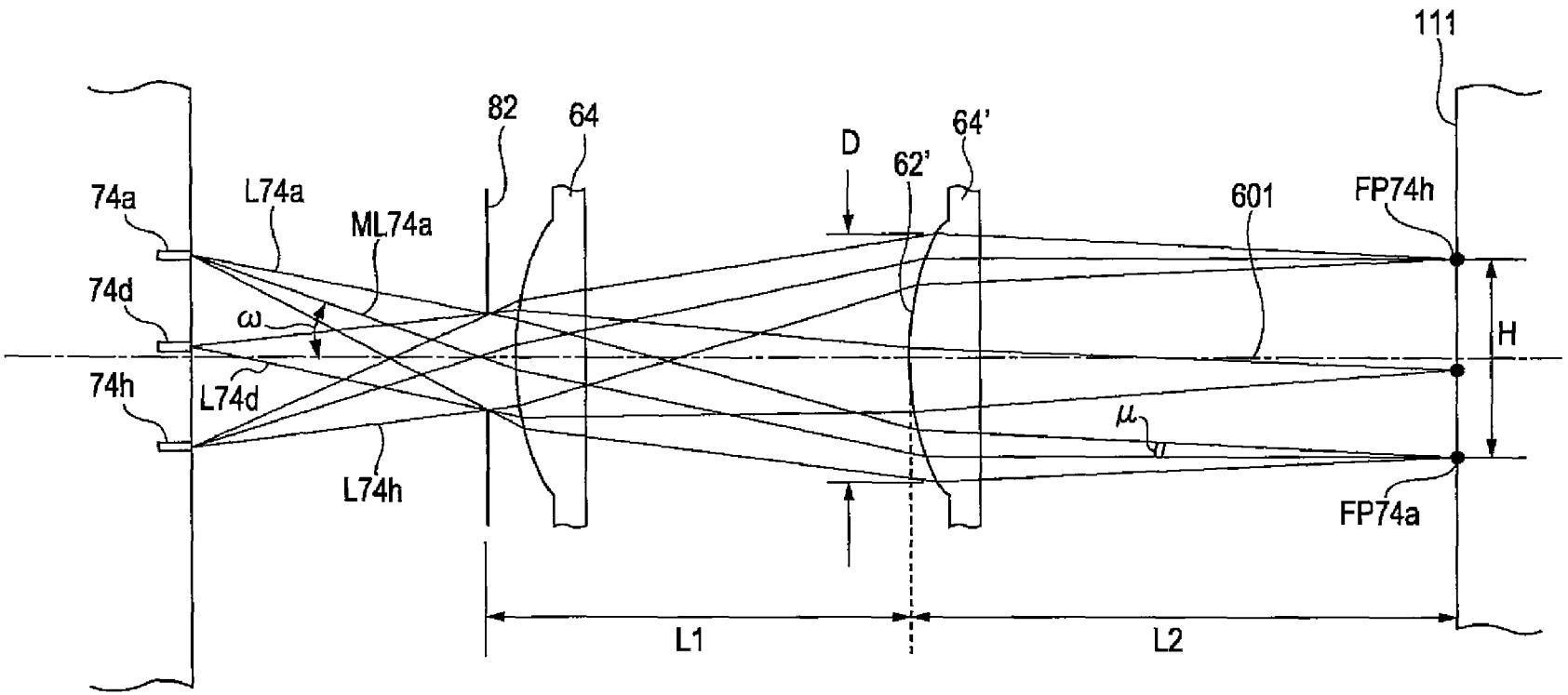
FIG. 6 is a view illustrating a principal ray of light emitted from light-emitting elements included in the line head illustrated in FIG. 2.
Figure 7:
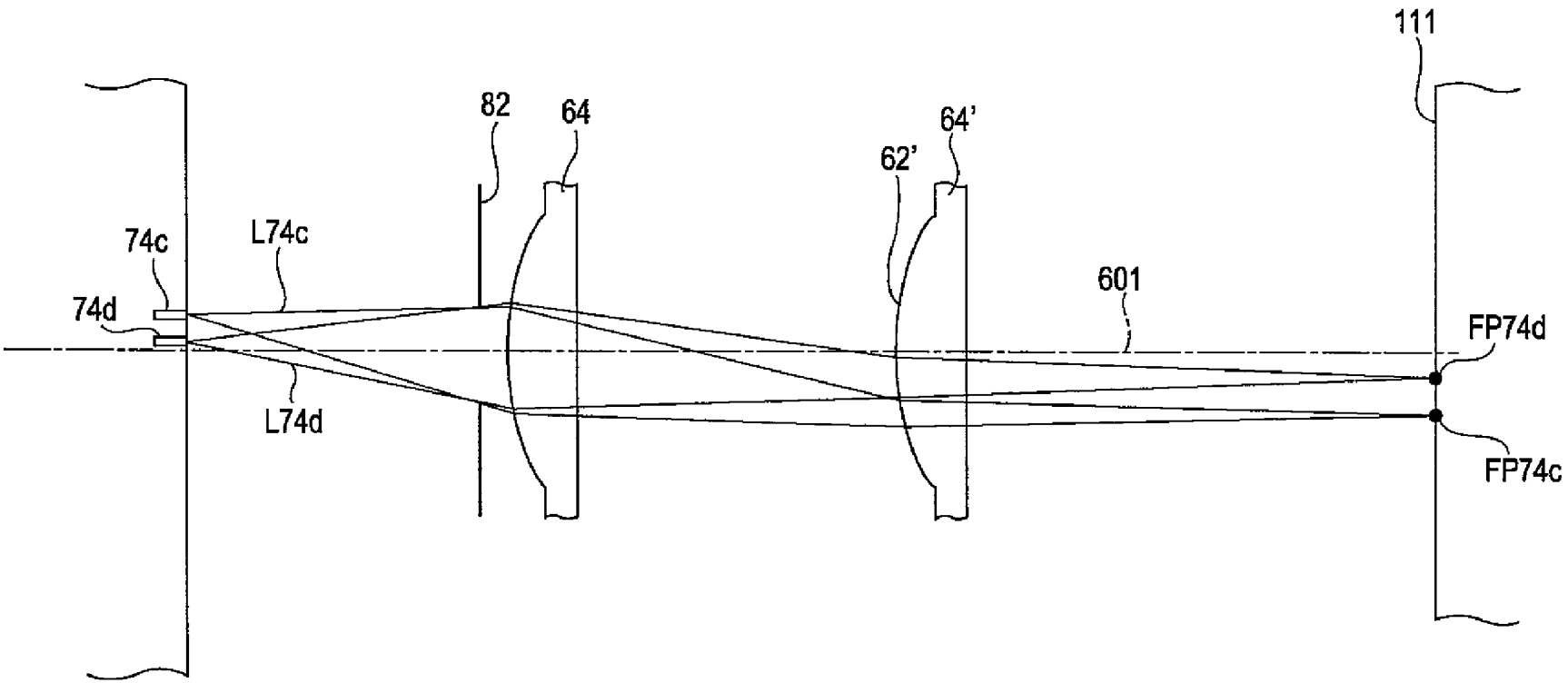
FIG. 7 is a view illustrating imaging points of an optical system included in the line head illustrated in FIG. 2.
Figure 8:
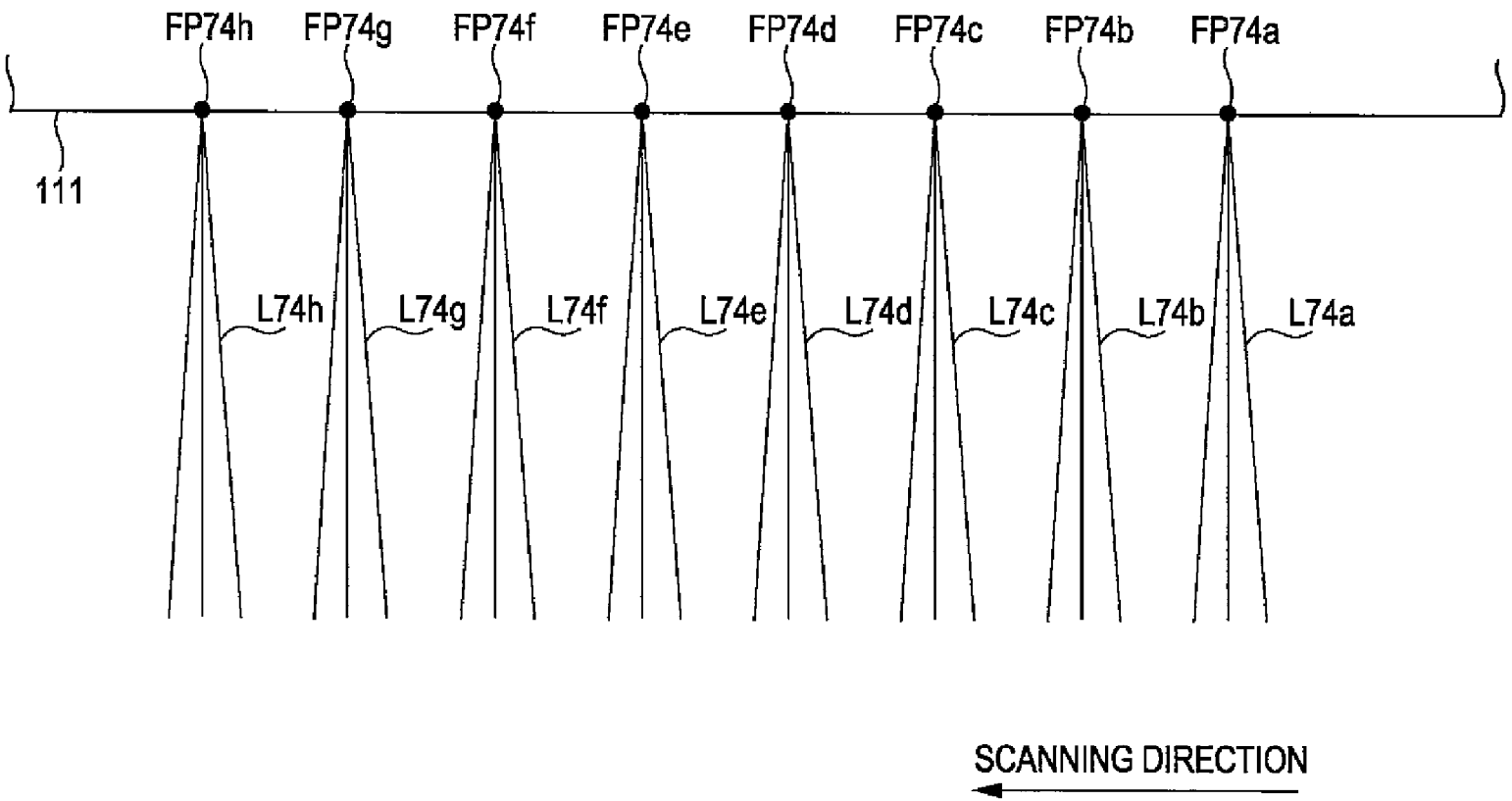
FIG. 8 is a view illustrating imaging points of an optical system included in the line head illustrated in FIG. 2.
Figure 15:
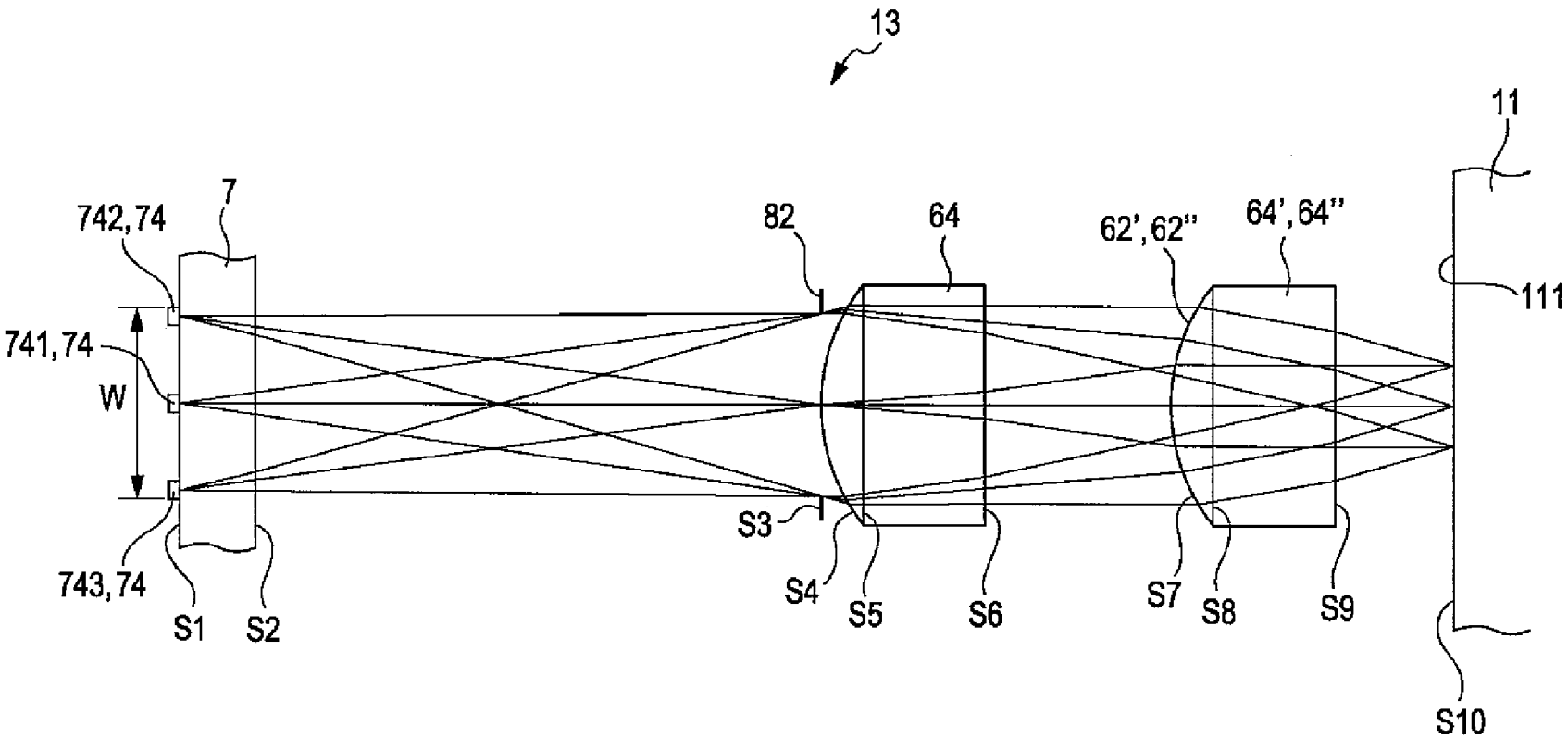
FIG. 15 is a view illustrating Example of the invention.
Figure 16:
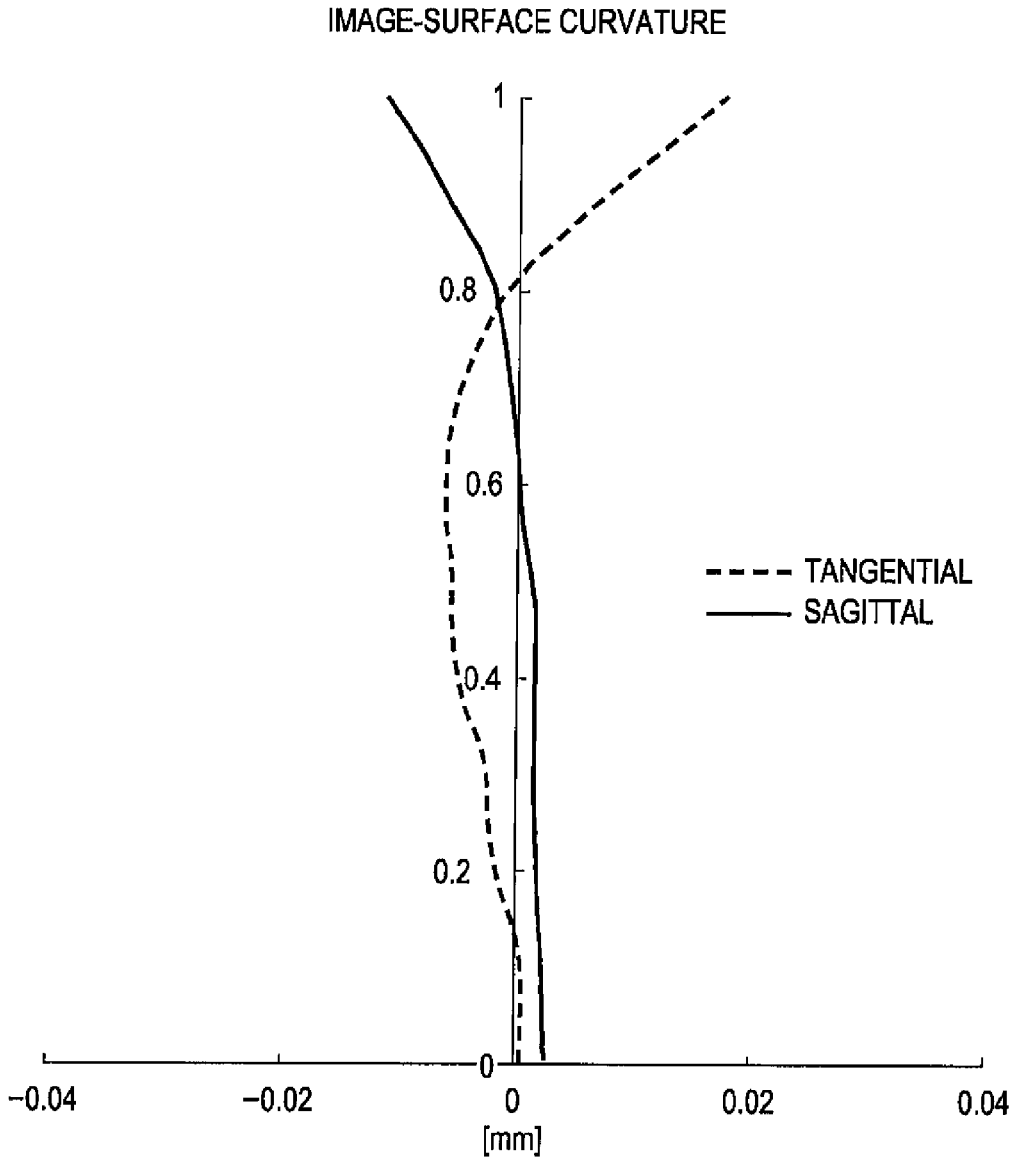
FIG. 16 is a graph illustrating a change in the optical axis direction of the spot size in the optical system of Example.
Figure 17:
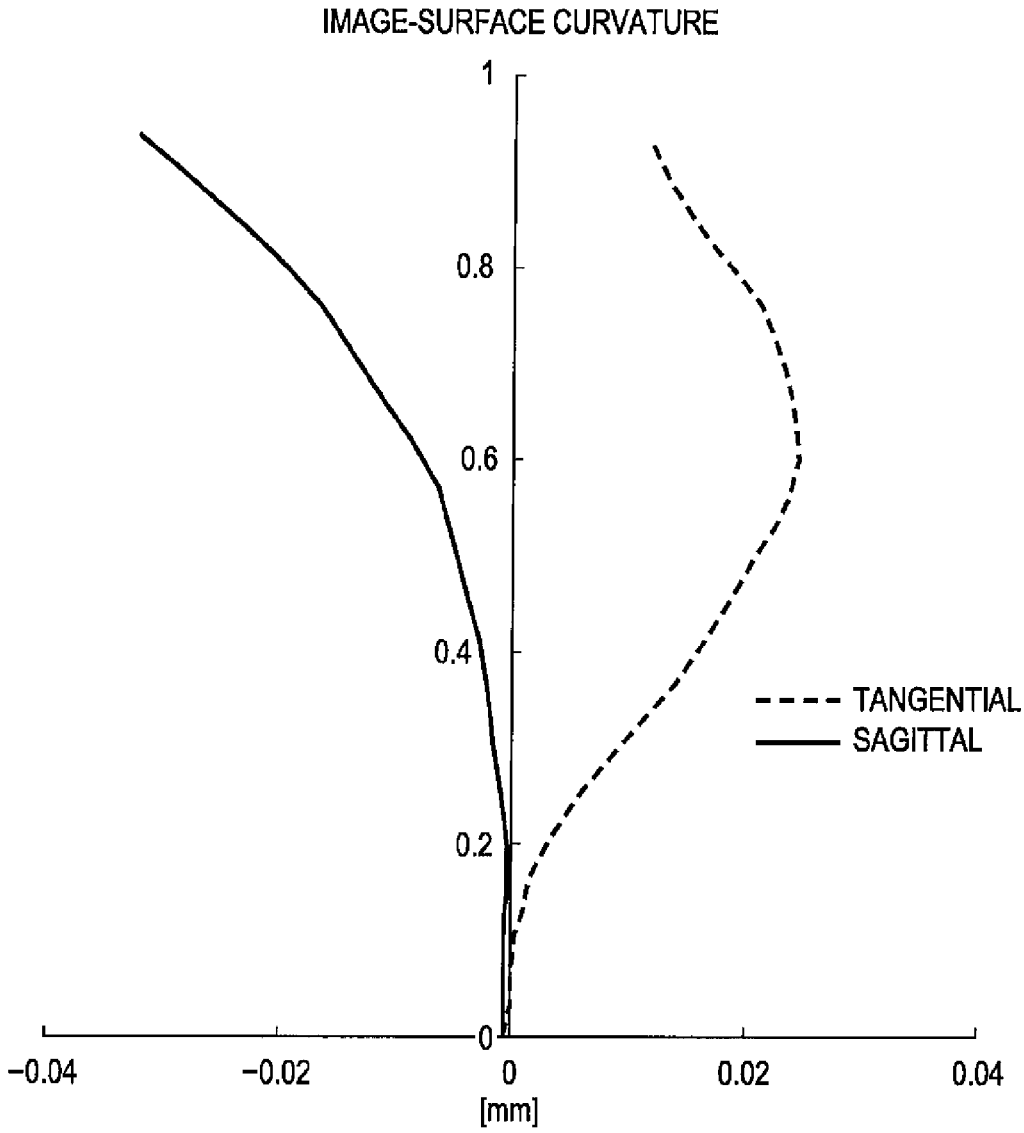
FIG. 17 is a graph illustrating a change in the optical axis direction of the spot size in the optical system of Comparative Example.

FIG. 1 is a schematic view illustrating the entire configuration of an image forming apparatus according to an embodiment of the invention. FIG. 2 is a partially sectional perspective view illustrating the line head included in the image forming apparatus illustrated in FIG. 1. FIG. 3 is a cross-sectional view taken along the line III-III of FIG. 2. FIG. 4 is a plan view of the line head illustrated in FIG. 2. FIG. 5 is a plan view of a lens included in the line head illustrated in FIG. 2. FIG. 6 is a view illustrating a principal ray of light emitted from light-emitting elements included in the line head illustrated in FIG. 2. FIGS. 7 and 8 are views illustrating imaging points of an optical system included in the line head illustrated in FIG. 2. FIGS. 9 to 14 are perspective views schematically illustrating an operation state over time in the line head illustrated in FIG. 2. FIG. 15 is a view illustrating Example of the invention. FIGS. 16 and 17 are graphs illustrating a change in the optical axis direction of the spot size in the optical systems of Example and Comparative Example, respectively. In the following description, it is assumed that an upper side in FIGS. 1 to 3 and FIGS. 10 to 16 is "upper" or "upward" and a lower side in the drawings is "lower" or "downward" for convenience of explanation.

Image Forming Apparatus

An image forming apparatus 1 illustrated in FIG. 1 is an electrophotographic printer that records an toner image on a recording medium P by a series of image forming processes including an electrical charging process, an exposure process, a developing process, a transferring process, and a fixing process. In the present embodiment, the image forming apparatus 1 is a so-called tandem type color printer.

As illustrated in FIG. 1, the image forming apparatus 1 includes: an image forming unit 10 for the electrical charging process, the exposure process, the developing process; a transfer unit 20 for the transferring process; a fixing unit 30 for the fixing process; a transport mechanism 40 for transporting the recording mediums P, such as paper; and a paper feed unit 50 that supplies the recording medium P to the transport mechanism 40.

The image forming unit 10 has four image forming stations: an image forming station 10Y that forms a yellow toner image, an image forming station 10M that forms a magenta toner image, an image forming station 10C that forms a cyan toner image, and an image forming station 10K that forms a black toner image.

Each of the image forming stations 10Y, 10C, 10M, and 10K has a photosensitive drum (photoconductor) 11 that carries an electrostatic latent image thereon. A charging unit 12, a line head (exposure unit) 13, a developing unit 14, and a cleaning unit 15 are provided around the periphery (outer peripheral side) of the photosensitive drum 11. Since these units that form the image forming stations 10Y, 10C, 10M, and 10K have the same configurations, one of the units will be hereinafter described.

The photosensitive drum 11 has a cylindrical shape as an overall shape. An outer peripheral surface (cylindrical surface) of the photosensitive drum 11 forms a light receiving surface 111 that receives light L (emitted light) from the line head 13 (lens array 6). That is, a photosensitive layer (not shown) is formed on the outer peripheral surface of the photosensitive drum 11. In addition, the photosensitive drum 11 is configured to be rotatable around an axial line thereof along the direction indicated by the arrow in FIG. 1. In addition, a portion (both ends) of the outer peripheral surface of the photosensitive drum 11 excluding light receiving surface 111 is a non-photosensitive region 112 that is not photosensitized by light L.

The charging unit 12 uniformly charges the light receiving surface 111 of the photosensitive drum 11 by corona charging or the like.

The line head 13 receives image information from a host computer (not shown) such, as a personal computer and irradiates the light L towards the light receiving surface 111 of the photosensitive drum 11 in response to the image information. When the light L is irradiated to the uniformly charged light receiving surface 111 of the photosensitive drum 11, a latent image corresponding to an irradiation pattern of the light L is formed on the light receiving surface 111. The configuration of the line head 13 will be described in detail later.

The developing unit 14 has a reservoir (not shown) storing toner therein and supplies toner from the reservoir to the light receiving surface 111 of the photosensitive drum 11 that carries the electrostatic latent image and applies toner thereon. As a result, the latent image on the photosensitive drum 11 is visualized (developed) as a toner image.

The cleaning unit 15 has a cleaning blade 151, which is made of rubber and makes abutting contact with the light receiving surface 111 of the photosensitive drum 11, and is configured to remove toner, which remains on the photosensitive drum 11 after a primary transfer to be described later, by scraping the remaining toner with the cleaning blade 151.

The transfer unit 20 is configured to collectively transfer toner images corresponding to respective colors, which are formed on the photosensitive drums 11 of the image forming stations 10Y, 10M, 10C, and 10K described above, onto the recording medium P.

In each of the image forming stations 10Y, 10C, 10M, and 10K, electrical charging of the light receiving surface 111 of the photosensitive drum 11 performed by the charging unit 12, exposure of the light receiving surface 111 performed by the line head 13, supply of toner to the light receiving surface 111 performed by the developing unit 14, primary transfer to an intermediate transfer belt 21, caused by pressure between the intermediate transfer belt 21 and a primary transfer roller 22, which will be described later, and cleaning of the light receiving surface 111 performed by the cleaning unit 15 are sequentially performed while the photosensitive drum 11 rotates once.

The transfer unit 20 has the intermediate transfer belt 21 having an endless belt shape. The intermediate transfer belt 21 is stretched over the plurality (four in the configuration illustrated in FIG. 1) of primary transfer rollers 22, a driving roller 23, and a driven roller 24. The intermediate transfer belt 21 is driven to rotate in the direction indicated by the arrow illustrated in FIG. 1 and at approximately the same speed as a circumferential speed of the photosensitive drum 11 by rotation of the driving roller 23.

Each primary transfer roller 22 is provided opposite the corresponding photosensitive drum 11 with the intermediate transfer belt 21 interposed therebetween and is configured to transfer (primary transfer) a monochrome toner image on the photosensitive drum 11 to the intermediate transfer belt 21. At the time of primary transfer, a primary transfer voltage (primary transfer bias), which has an opposite polarity to that of electrically charged toner is applied to the primary transfer roller 22.

A toner image corresponding to at least one of the colors yellow, magenta, cyan, and black is carried on the intermediate transfer belt 21. For example, when a full color image is formed, toner images corresponding to the four colors yellow, magenta, cyan, and black are sequentially transferred onto the intermediate transfer belt 21 so as to overlap one another so that a full color toner image is formed as an intermediate transfer toner image.

In addition, the transfer unit 20 has a secondary transfer roller 25, which is provided opposite the driving roller 23 with the intermediate transfer belt 21 interposed therebetween, and a cleaning unit 26, which is provided opposite the driven roller 24 with the intermediate transfer belt 21 interposed therebetween.

The secondary transfer roller 25 is configured to transfer (secondary transfer) a monochrome or full-color toner image (intermediate transfer toner, image), which is formed on the intermediate transfer belt 21, to the recording medium P such as paper, a film, or cloth, which is supplied from the paper feed unit 50. At the time of secondary transfer, the secondary transfer roller 25 is pressed against the intermediate transfer belt 21, and a secondary transfer voltage (secondary transfer bias) is applied to the secondary transfer roller 25. The driving roller 23 also functions as a backup roller of the secondary transfer roller 25 at the time of such secondary transfer.

The cleaning unit 26 has a cleaning blade 261, which is made of rubber and makes abutting contact with a surface of the intermediate transfer belt 21, and is configured to remove toner, which remains on the intermediate transfer belt 21 after the secondary transfer, by scraping the remaining toner with the cleaning blade 261.

The fixing unit 30 has a fixing roller 301 and a pressure roller 302 pressed against the fixing roller 301 and is configured such that the recording medium P passes between the fixing roller 301 and the pressure roller 302. In addition, the fixing roller 301 is provided with a heater that is provided at an inside thereof so as to heat an outer peripheral surface of the fixing roller 301 so that the recording medium P passing between the fixing roller 301 and the pressure roller 302 can be heated and pressed. By the fixing unit 30 having such a configuration, the recording medium P having a secondary-transferred toner image thereon is heated and pressed, such that the toner image is heat-fixed on the recording medium P as a permanent toner image.

The transport mechanism 40 has a resist roller pair 41, which transports the recording medium P to a secondary transfer position while calculating the timing of paper feeding to the secondary transfer position between the secondary transfer roller 25 and the intermediate transfer belt 21 described above, and transport roller pairs 42, 43, and 44 that pinch and transport only the recording medium P, on which the fixing process in the fixing unit 30 has been completed.

When an toner image is formed on only one surface of the recording medium P, the transport mechanism 40 pinches and transports the recording medium P, in which one surface thereof has been subjected to the fixing process by the fixing unit 30, using the transport roller pair 42 and discharges the recording medium P to the outside of the image forming apparatus 1. When toner images are formed on both surfaces of the recording medium P, the recording medium P in which one surface thereof has been subjected to the fixing process by the fixing unit 30 is first pinched by the transport roller pair 42. Then, the transport roller pair 42 is reversely driven and the transport roller pairs 43 and 44 are driven so as to reverse the recording medium P upside down and transport the recording medium P back to the resist roller pair 41. Then, another toner image is formed on the other surface of the recording medium P by the same operation as described above.

The paper feed unit 50 is provided with a paper feed cassette 51, which stores therein the recording medium P that has not been used, and a pickup roller 52 that feeds the recording medium P from the paper feed cassette 51 toward the resist roller pair 41 one at a time.

Line Head

Next, the line head 13 will be described in detail. In the following description, the longitudinal direction of the long line head 13 (first lens array 6 and second lens array 6' to be described later) will be referred to as a "main-scanning direction" and the width direction of the line head 13 will be referred to as a "sub-scanning direction" for the convenience of explanation.

As illustrated in FIG. 3, the line head 13 is arranged below the photosensitive drum 11 so as to oppose the light receiving surface 111 of the photosensitive drum 11. Moreover, the line head 13 is arranged such that the main-scanning direction thereof is in parallel to the rotation axis of the photosensitive drum 11.

The line head 13 includes the second lens array 6', a spacer 84, the first lens array 6, a spacer 83, a diaphragm 82, a light shielding member 81, and a light-emitting element array 7, which are sequentially arranged in that order from the side of the photosensitive drum 11 and are accommodated in a casing 9.

In the line head 13, the light L emitted from the light-emitting element array 7 is collimated by the diaphragm 82 and sequentially passes through the first lens array 6 and the second lens array 6' to be focused on the light receiving surface 111 of the photosensitive drum 11.

As illustrated in FIGS. 2 to 4, the first lens array 6 is formed of a planar member having a long appearance. A plurality of convex surfaces (lens surfaces) 62 is formed on a surface (incidence surface on which the light L is incident) of the first lens array 6 close to the light-emitting element array 7. On the other hand, a surface (emission surface from which the light L is emitted) of the first lens array 6 close to the photosensitive drum 11 is configured as a flat surface.

That is to say, the first lens array 6 includes a plurality of plano-convex lenses 64, each of the lenses having a convex surface 62 on a surface on which the light L is incident and a flat surface on a surface from which the light L is emitted. Moreover, a portion (mainly, a peripheral portion of each of the lenses 64) of the first lens array 6 excluding the respective lenses 64 constitutes a support portion 65 that supports each of the lenses 64. The configuration of the respective lenses 64 will be described in detail later.

As illustrated in FIG. 4, the lenses 64 are arranged in plural columns in the main-scanning direction, and are arranged in plural rows in the sub-scanning direction that is orthogonal to the main-scanning direction and a optical axis direction of the lenses 64.

More specifically, the plurality of lenses 64 are arranged in a matrix of three rows by n columns (n is an integer of two or more). In the following description, among the three lenses 64 belonging to one column (lens array), the lens 64 positioned in the middle will be referred to as a "lens 64*b*", the lens 64 positioned at the left side in FIG. 3 (upper side in FIG. 4) will be referred to as a "lens 64*a*", and the lens 64 positioned at the right side in FIG. 3 (lower side in FIG. 4) will be referred to as a "lens 64*c*".

In the present embodiment, the line head 13 is mounted on the image forming apparatus so that, among the plural lenses 64 (64*a* to 64*c*) belonging to one column, the lens 64*b* positioned closest to the center in the sub-scanning direction is arranged at the position close to the light receiving surface 111 of the photosensitive drum 11. By doing so, the optical characteristics of the optical system 60, which will be described later, can be configured easily.

As illustrated in FIG. 4, in each lens column, the lenses 64*a* to 64*c* are sequentially arranged so as to be offset by an equal distance in the main-scanning direction (right direction in FIG. 4). That is, in each lens column, a line that connects the centers of the lenses 64*a* to 64*c* to one another is inclined at a predetermined angle with respect to the main-scanning direction and the sub-scanning direction.

When seen from the cross section illustrated in FIG. 3, the three lenses 64 belonging to one lens column, namely the lenses 64*a* and 64*c*, are arranged such that the optical axes of the lenses 64*a* and 64*c* are symmetrical with respect to the optical axis of the lens 64*b*. Moreover, the optical axes of the lenses 64*a* to 64*c* are arranged in parallel to each other.

As illustrated in FIG. 3, the second lens array 6' is provided on the emission side of the first lens array 6 from which the light L is emitted, with the spacer 84 interposed therebetween. The second lens array 6' has substantially the same configuration as the first lens array 6. Specifically, a plurality of convex surfaces (lens surfaces) 62' is formed on a surface of the second lens array 6' close to the first lens array 6, and a surface of the second lens array 6' close to the photosensitive drum 11 is configured as a flat surface.

That is to say, the second lens array 6' includes a plurality of plano-convex lenses 64', each of the lenses having a convex surface 62' on a surface on which the light L is incident and a flat surface on a surface from which the light L is emitted. Moreover, a portion of the second lens array 6' excluding the respective lenses 64' constitutes a support portion 65' that supports each of the lenses 64'. The configuration of the respective lenses 64' will be described in detail later.

The plurality of lenses 64' are separated from each other and arranged in a matrix of three rows by n columns (n is an integer of two or more) so as to correspond to the plurality of lenses 64 described above. That is to say, the plurality of lenses 64' are arranged in a matrix form as illustrated in FIG. 4. Furthermore, the plurality of lenses 64' are arranged so that respective one of the lenses 64' opposes respective one of the lenses 64, and an optical axis thereof is identical to the optical axis of the opposing lens 64.

An antifouling treatment may be performed on the upper surface (the flat surface being exposed to the outside of the line head 13) of the second lens array 6'. A treatment for preventing or suppressing adhesion of dirt onto the upper surface and a treatment for easily removing dirt even if the dirt adheres to the upper surface may be mentioned as the antifouling treatment. As such an antifouling treatment, for example, a method of applying a fluorine-containing silane compound onto the upper surface, for example, using a dipping method may be mentioned (for example, refer to JP-A-2005-3817).

In addition, an anti-scratch treatment may also be performed on the upper surface of the second lens array 6'.

As the anti-scratch treatment, for example, a method of forming a layer, which contains $C_6H_{14}$ and $C_2F_6$ as main materials, on the upper surface by using a vapor deposition method, such as a high-frequency plasma CVD method, may be used (for example, refer to JP-A-2006-133420).

Moreover, when the antifouling treatment or the anti-scratch treatment is performed on the upper surface of the second lens array 6', the operation can be easily performed because the upper surface is a flat surface. In addition, since the upper surface is a flat surface, a layer formed by the antifouling treatment or the anti-scratch treatment can be uniformly formed on the upper surface.

Although the constituent materials of the lenses 64 and 64' are not particularly limited as long as they exhibit the optical characteristics described above, the lenses 64 and 64' are preferably formed of a resin material and/or a glass material, for example.

As the resin material, various kinds of resin materials can be used. Examples thereof include liquid crystal polymers such as polyamides, thermoplastic polyimides and polyamideimide aromatic polyesters; polyolefins such as polyphenylene oxide, polyphenylene sulfide and polyethylene; polyesters such as modified polyolefins, polycarbonate, acrylic (methacrylic) resins, polymethyl methacrylate, polyethylene terephthalate and polybutylene terephthalate; thermoplastic resins such as polyethers, polyether ether ketones, polyetherimide and polyacetal; thermosetting resins such as epoxy resins, phenolic resins, urea resins, melamine resins, unsaturated polyester resins and polyimide resins; photocurable resins; and the like. These can be used individually or in combination of two or more species.

Among these resin materials, resin materials such as thermosetting resins and photocurable resins are preferred because such materials have a relatively low thermal expansion coefficient and are rarely thermally expanded (deformed), modified or deteriorated, in addition to the advantages of a relatively high refractive index.

In addition, as the glass material, various kinds of glass materials, such as soda glass, crystalline glass, quartz glass, lead glass, potassium glass, borosilicate glass, alkali-free glass, and the like may be mentioned. When a supporting plate 72 (to be described later) of the light-emitting element array 7 is formed of a glass material, the lenses 64 and 64' are preferably formed of a glass material having approximately the same linear expansion rate as the above glass material. By doing so, the positional misalignment of the respective lenses relative to the light-emitting elements due to temperature variation can be prevented.

When the first and second lens arrays 6 and 6' are formed by using a combination of the described resin material and glass material, a resin layer formed of a resin material may be formed on one surface of a glass substrate formed of a glass material, thus obtaining a laminated structure, and the convex surface 62 or 62' may be formed on a surface of the resin layer opposite the glass substrate. In addition, the first and second lens arrays 6 and 6' may be obtained, for example, by forming a plurality of convex portions, which protrudes in a convex surface shape, on one surface of a flat plate-like member (substrate) of which the upper and lower surfaces are configured as flat surfaces. In this case, from the perspective of facilitating manufacturing and securing the rigidity of the first and second lens arrays 6 and 6', it is preferable that the flat plate-like member is formed of a glass material and each convex portion is formed of a resin material, for example.

In the following description, among the three lenses 64' belonging to one column (lens array), the lens 64' opposing the lens 64*a* will be referred to as a "lens 64*a*'", the lens 64' opposing the lens 64*b* will be referred to as a "lens 64*b*'", and the lens 64' opposing the lens 64*c* will be referred to as a "lens 64*c*'" (see FIG. 3).

Although it has been described on the first lens array 6 having a plurality of lenses 64 and the second lens array 6' having a plurality of lenses 64', in the line head 13 of the present embodiment, one set of corresponding lenses 64 and 64' forms one optical system 60. In the following description, the optical system 60 formed by a set of lenses 64*a* and 64*a*' will be referred to as an "optical system a", the optical system 60 formed by a set of lenses 64*b* and 64*b*' will be referred to as an "optical system b", and the optical system 60 formed by a set of lenses 64*c* and 64*c*' will be referred to as an "optical system c", for convenience of explanation (see FIG. 3).

As illustrated in FIG. 3, at a side of the first lens array 6 on which the light L is incident, the light-emitting element array 7 is provided with the spacer 83, the diaphragm 82, and the light shielding member 81 interposed therebetween. The light-emitting element array 7 has a plurality of groups of light-emitting elements (light-emitting element groups) 71 and a supporting plate (head substrate) 72.

The supporting plate 72 is configured to support each of the light-emitting element groups 71 and is formed of a planar member having a long appearance. The supporting plate 72 is arranged in parallel to the first lens array G.

In addition, the length of the supporting plate 72 in the main-scanning direction is larger than that of the first lens array 6 in the main-scanning direction. The length of the supporting plate 72 in the sub-scanning direction is also set to be larger than that of the first lens array 6 in the sub-scanning direction.

Although the constituent materials of the supporting plate 72 are not particularly limited, when the light-emitting element groups 71 are provided on the bottom surface side of the supporting plate 72 (that is, bottom emission-type light-emitting elements are used as the light-emitting elements 74), the supporting plate 72 is preferably formed of transparent materials such as various kinds of glass materials or various kinds of plastics. When top emission-type light-emitting elements are used as the light-emitting elements 74, the constituent materials of the supporting plate 72 are not limited to the transparent materials, various kinds of metallic materials, such as aluminum or stainless steel, various kinds of glass materials, various kinds of plastics, and the like may be used individually or in combination thereof. When the supporting plate 72 is formed of various kinds of metallic materials or various kinds of glass materials, heat generated by emission of the light-emitting elements 74 can be efficiently dissipated through the supporting plate 72. When the supporting plate 72 is formed of various kinds of plastics, the weight of the supporting plate 72 can be reduced.

A box-shaped accommodation portion 73 that is open to the supporting plate 72 is provided on the bottom surface side of the supporting plate 72. The plurality of light-emitting element groups 71, wiring lines (not shown) electrically connected to the light-emitting element groups 71 (the respective light-emitting elements 74), or circuits (not shown) used for driving the respective light-emitting elements 74 are accommodated in the accommodation portion 73.

The plurality of light-emitting element groups 71 are separated from each other and arranged in a matrix of three rows by n columns (n is an integer of two or more) so as to correspond to the plurality of lenses 64 (optical system 60) described above (for example, see FIG. 4). Each of the light-emitting element groups 71 is configured to include a plurality (8 in the present embodiment) of light-emitting elements 74.

As illustrated in FIG. 3, the eight light-emitting elements 74 that constitute each of the light-emitting element groups 71 are arranged along a lower surface 721 of the supporting plate 72. The light L emitted from each of the light-emitting elements 74 is collimated by the diaphragm 82 and passes through the optical system 60 (the lens 64 and the lens 64') to be focused on the light receiving surface 111 of the photosensitive drum 11. Although it will be described later, the light L emitted from each of the light-emitting elements 74 is irradiated on the light receiving surface 111, whereby a spot SP is formed on the light receiving surface 111.

In addition, as illustrated in FIG. 4, the eight light-emitting elements 74 are separated from each other and are arranged in four columns in the main-scanning direction and in two rows in the sub-scanning direction. Thus, the eight light-emitting elements 74 are arranged in a matrix of two rows by four columns. The two adjacent light-emitting elements 74 belonging to one column (column of light-emitting elements) are arranged so as to be offset from each other in the main-scanning direction. In the eight light-emitting elements 74 that form a matrix of two rows by four columns, two light-emitting elements 74 that are adjacent to each other in the main-scanning direction are supplemented by one light-emitting element 74 in a next row.

There is a limitation in arranging the eight light-emitting elements 74 as closely as possible in one row, for example. However, it is possible to increase further the arrangement density of the light-emitting elements 74 by arranging the eight light-emitting elements 74 so as to be offset from each other as described above. In this way, the recording density of the recording medium P when a toner image is recorded on the recording medium P can be increased further. As a result, it is possible to obtain the recording medium P carrying thereon a toner image that has high resolution and multiple gray-scale levels and is clear.

In addition, although the eight light-emitting elements 74 belonging to one light-emitting element group 71 are arranged in a matrix of two rows by four columns in the present embodiment, the arrangement shape is not limited thereto. For example, the eight light-emitting elements 74 may be arranged in a matrix of two rows by eleven columns or four rows by two columns.

As described above, the plurality of light-emitting element groups 71 are arranged in a matrix of three rows by n columns so as to be separated from each other. As illustrated in FIG. 4, the three light-emitting element groups 71 belonging to one column (column of light-emitting element groups) are arranged so as to be offset from each other by an equal distance in the main-scanning direction (right direction in FIG. 4).

Thus, in the light-emitting element groups 71 that form a matrix of three rows by n columns, the gaps between adjacent light-emitting element groups 71 are sequentially supplemented by the light-emitting element group 71 of a next row and the light-emitting element group 71 of a subsequent row.

There is a limitation in arranging the plurality of light-emitting element groups 71 as closely as possible in one row, for example. However, it is possible to increase further the arrangement density of the light-emitting element groups 71 by arranging the plurality of light-emitting element groups 71 so as to be offset from each other as described above. In this way, by the synergetic effect with the fact that the eight light-emitting elements 74 within one light-emitting element group 71 are arranged so as to be offset from each other, the recording density of the recording medium P when a toner image is recorded on the recording medium P can be increased further. As a result, it is possible to obtain the recording medium P carrying thereon a toner image that has higher resolution, multiple gray-scale levels, and high color reproducibility and is clearer.

The light-emitting elements 74 are bottom emission-type organic electroluminescence (OLED) element. The light-emitting elements 74 are not limited to the bottom emission-type elements and may be top emission-type elements. In this case, the supporting plate 72 is not required to have optically transparent properties as described above.

When the light-emitting elements 74 are OLED elements, the gaps (pitches) between the light-emitting elements 74 can be set to be relatively small. In this way, the recording density of the recording medium P when a toner image is recorded on the recording medium P can be made relatively high. In addition, the light-emitting elements 74 can be formed with highly accurate sizes and at highly accurate positions by using various film-forming methods. As a result, it is possible to obtain the recording medium P carrying thereon a clearer toner image.

In the present embodiment, all of the light-emitting elements 74 are configured to emit red light. Here, as examples of the constituent materials of a light-emitting layer that emits red light, (4-dicyanomethylene)-2-methyl-6-paradimethylaminostyryl)-4H-pyrane (DCM), Nile Red and the like can be mentioned. In addition, the light-emitting elements 74 are not limited to those configured to emit red light, but may be configured to emit monochromatic light of another color or white light. Thus, in the OLED element, the light L emitted from the light-emitting layer can be appropriately set to monochromatic light of an arbitrary color in accordance with the constituent materials of the light-emitting layer.

Since the spectral sensitivity characteristic of the photosensitive drum used in the electrophotographic process is generally set to have a peak in a wavelength range of a red wavelength, which is the emission wavelength of a semiconductor laser, to a near-red wavelength, it is preferable to use the materials capable of emitting red light as described above.

As illustrated in FIG. 3, between the first lens array 6 and the light-emitting element array 7, the light shielding member 81, the diaphragm 82, and the spacer 83 are arranged in that order from the side of the light-emitting element array 7.

The light shielding member 81 is configured to prevent crosstalk of the light L between the adjacent light-emitting element groups 71. The light shielding member 81 is formed by using a block body having a long appearance. A plurality of through-holes 811 that pass through the light shielding member 81 in the up and down direction (thickness direction) of FIG. 3 are formed in the light shielding member 81 formed of a block body. Each of the through-holes 811 is arranged at the position corresponding to each of the described lenses 64 and forms a portion of an optical path that extends from the light-emitting element group 71 to the corresponding lens 64. In addition, each of the through-holes 811 has a circular shape in a plan view thereof and includes therein the eight light-emitting elements 74 of the light-emitting element group 71 corresponding to each of the through-holes 811. Although the through-holes 811 have a cylindrical shape in the configuration illustrated in FIG. 3, the invention is not limited thereto. For example, the through-holes 811 and 821 may have a circular truncated cone shape that expands upward.

The light shielding member 81 also functions as a spacer that regulates a distance (gap) between the light-emitting element array 7 and the diaphragm 82.

The diaphragm 82 is configured to permit only a portion of the light L emitted from each of the light-emitting element group 71 to reach the optical system 60. The diaphragm 82 is formed by providing a plurality of openings 821 to a planar member having a long appearance.

The plurality of openings 821 are formed at positions corresponding to the described lenses 64 (specifically, the through-holes 811). Furthermore, each of the openings 821 has a circular shape having a smaller diameter than the through-hole 811 in a plan view thereof and has a center thereof being located substantially at the same position as the corresponding through-hole, 811.

The spacer 83 is configured to regulate a distance (gap) between the diaphragm 82 and the first lens array 6. The spacer 83 is formed in the same manner as the light shielding member 81 described above, by forming a plurality of through-holes 831 in a block body having a long appearance so as to pass through the block body in the up and down direction (thickness direction) of FIG. 3. Each of the through-holes 831 is arranged at the position corresponding to each of the lenses 64 and forms an optical path that extends from the light-emitting element group 71 to the lens 64 in collaboration with the corresponding through-hole 811.

The light-emitting element array 7 and the light shielding member 81, the light shielding member 81 and the diaphragm 82, the diaphragm member 82 and the spacer 83, and the spacer 83 and the first lens array 6 may be fixed by bonding (bonding using adhesive or solvent), for example.

Moreover, the light shielding member 81 and the spacer 83 preferably have at least the inner peripheral surfaces of the respective through-holes 811 and 831 that have a dark color such as black, brown, or dark blue. Furthermore, the diaphragm 82 preferably has at least the inner peripheral surfaces of the respective openings 821 and a portion of a lower surface thereof exposed to the optical path, which have a dark color such as black, brown, or dark blue. In this way, it is possible to prevent the light L from being reflected from the inner peripheral surfaces of the through-holes 811 and 831 and the openings 821 when the light L is transmitted through the through-holes 811 and 831 and the openings 821.

In addition, although the constituent materials of the light shielding member 81, the diaphragm 82, and the spacer 83 are not particularly limited, the same constituent material as the supporting plate 72 may be used, for example.

As illustrated in FIG. 3, a spacer 84 is provided between the first lens arrays 6 and the second lens array 6'. The spacer 84 is configured to regulate a gap length that is a distance between the first lens array 6 and the second lens array 6'. Since the spacer 84 has the same configuration as the above-described spacer 83, the description thereof will be omitted.

As illustrated in FIGS. 2 and 3, the first lens array 6, the second lens array 6', the light-emitting element array 7, the light shielding member 81, the diaphragm 82, and the spacers 83 and 84 are collectively accommodated in the casing 9. The casing 9 has a frame member (casing body) 91, a lid member (bottom lid) 92, and a plurality of clamp members 93 that fixedly secures the frame member 91 to the lid member 92 (see FIG. 3).

The frame member 91 has a generally long shape, as illustrated in FIG. 2.

In addition, the frame member 91 has a frame shape, and an inner cavity portion 911 that is open to the upper and lower sides of the frame member 91 is formed in the frame member 91 as illustrated in FIG. 3. The width of the inner cavity portion 911 gradually decreases upwardly from the lower side of FIG. 3.

The second lens array 6', the spacer 84, the first lens array 6, the spacer 83, the diaphragm 82, the light shielding member 81, and the light-emitting element array 7 are inserted in the inner cavity portion 911, and they are fixed by adhesive, for example. In this way, the second lens array 6', the spacer 84, the first lens array 6, the spacer 83, the diaphragm 82, the light shielding member 81, and the light-emitting element array 7 are collectively held on the frame member 91, such that the positions in the main and sub-scanning directions of the second lens, array 6', the spacer 84, the first lens array 6, the spacer 83, the diaphragm 82, the light shielding member 81, and the light-emitting element array 7 are determined.

Here, an upper surface 722 of the supporting plate 72 of the light-emitting element array 7 is in contact (abutting contact) with a stepped portion 915, which is formed on a wall surface of the inner cavity portion 911, and the lower end surface of the light shielding member 81. The lid member 92 is inserted into the inner cavity portion 911 from the lower side.

The lid member 92 is formed of a lengthy member having a recess portion 922 in which the accommodation portion 73 is inserted at an upper side thereof. The edge portions of the supporting plate 72 of the light-emitting element array 7 are pinched between the upper end surface of the lid member 92 and the boundary portion 915 of the frame member 91.

Moreover, the lid member 92 is pressed upward by each of the clamp members 93. In this way, the lid member 92 is fixed to the frame member 91. In addition, by the pressed lid member 92, the positional relationships among the second lens array 6', the spacer 84, the first lens array 6, the spacer 83, the diaphragm 82, the light shielding member 81, and the light-emitting element array 7 in the main-scanning direction, the sub-scanning direction, and the up and down direction of FIG. 3 are fixed.

The clamp members 93 are preferably arranged in plural numbers at equal intervals in the main-scanning direction. Accordingly, the frame member 91 and the lid member 92 can be pinched uniformly in the main-scanning direction.

The clamp member 93 has a generally U shape in the cross section illustrated in FIG. 3 and is formed by folding a metallic plate. Both ends of the clamp member 93 are bent inward to form claw portions 931. The claw portions 931 are engaged with shoulder portions 916 of the frame member 91.

In addition, a curved portion 932 that is curved upward in an arch shape is formed in the middle portion of the clamp member 93. The apex of the curved portion 932 is in pressure-contact with the lower surface of the lid member 92 in a state where the claw portions 931 are engaged with the shoulder portion 916. In this way, the curved portion 932 urges the lid member 92 upwardly in a state where the curved portion 932 is elastically deformed.

In addition, when the clamp members 93 that pinch the frame member 91 and the lid member 92 are detached, the lid member 92 can be detached from the frame member 91. Then, it is possible to perform maintenance, such as replacement and repair, for the light-emitting element array 7.

Furthermore, the constituent materials of the frame member 91 and the lid member 92 are not particularly limited, and the same constituent materials as the supporting plate 72 may be used, for example. The constituent materials of the clamp member 93 are not particularly limited, and aluminum or stainless steel may be used, for example. In addition, the clamp member 93 may also be formed of a hard resin material.

Moreover, although not illustrated in the drawings, the frame member 91 has spacers that are provided at both ends in the longitudinal direction thereof so as to protrude upward. The spacers are configured to regulate the distance between the light receiving surface 111 of the photosensitive drum 11 and the first and second lens arrays 6 and 6'.

Optical System

Next, the optical system 60 of the line head 13 will be described. As described above, in the line head 13, a plurality of optical systems 60 are arranged in a matrix form, in which one optical system 60 is formed by one lens 64 and one lens 64 corresponding thereto. In the present embodiment, each optical system 60 is an optical system that is telecentric on the light emission side (the side of the photosensitive drum 11). Furthermore, in the present embodiment, the optical axis 601 passes through the geometrical center of the light-emitting element group 71 in a direction perpendicular to the substrate surface of the light-emitting element array 7.

Since a plurality of optical system 60 have the same configuration, one optical system 60 will be described as a representative example, for the convenience of explanation, and other optical systems 60 will not be described.

First, two lenses 64 and 64' constituting the optical system 60 will be described.

The lens 64 generally has a circular shape in a plan view thereof. The lens surface 62 of the lens 64 is configured as an aspheric lens surface that is rotationally symmetrical to the optical axis 601. The surface shape of the lens surface 62 is defined by Formula 1 below.

$$\frac{CUr^2}{1+\sqrt{1-(1+K)\cdot CU^2r^2}}+Ar^4+Br^6+Cr^8 \quad (1)$$

In Formula 1 above, r is a distance from the optical axis, CU is an apex curvature, K is a conic coefficient, and A, B, and C are aspheric coefficients.

The lens 64' generally has a circular shape in a plan view thereof. Moreover, the lens surface (first lens surface) 62' of the lens 64' is defined by Formula 2 below.

$$\frac{CU\cdot(x^2+y^2)}{1+\sqrt{1-(1+k)\cdot CU^2\cdot(x^2+y^2)}}+C_{0,2}y^2+C_{4,0}x^4+C_{2,2}x^2y^2+C_{1,3}xy^3+C_{0,4}y^4+C_{6,0}x^6+C_{4,2}x^4y^2+C_{2,4}x^2y^4+C_{0,6}y^6 \quad (2)$$

In Formula 2 above, x is the coordinate in the main direction (main-scanning direction), y is the coordinate in the sub direction (sub-scanning direction), CU is an apex curvature, K is a conic coefficient, and $C_{m,n}$ is the coefficient of $x^m y^n$.

Next, the arrangement of the two lenses 64 and 64' will be described with reference to FIGS. 5 to 8. In the following description, as illustrated in FIG. 5, the eight light-emitting elements 74 that are included in the light-emitting element group 71 and arranged in the main-scanning direction (first direction) will be respectively referred to as "light-emitting element 74*a*", "light-emitting element 74*b*", "light-emitting element 74*c*", "light-emitting element 74*d*", "light-emitting element 74*e*", "light-emitting element 74*f*", "light-emitting element 74*g*", and "light-emitting element 74*h*" in order from the left side in FIG. 5, for the convenience of explanation. Moreover, among these eight light-emitting elements 74*a* to 74*h*, the light-emitting elements 74*d* and 74*e* are located the closest to the optical axis 601, and the light-emitting elements 74*a* and 74*h* are located the furthest from the optical axis 601.

FIG. 6 is a cross-sectional view taken along the main-scanning direction so as to include the optical axis 601. Specifically, FIG. 6 illustrates light L74*a* emitted from the light-emitting element (second light-emitting element) 74*a* that is located on the left side of the optical axis 601 in FIG. 5 and is located the furthest from the optical axis 601, L74*h* emitted from the light-emitting element (third light-emitting element) 74*h* that is located on the right side of the optical axis 601 in FIG. 5 and is located the furthest from the optical axis 601, and light L74*d* emitted from the light-emitting element (first light-emitting element) 74*d* that is located the closest to the optical axis 601. As illustrated in the drawing, the lenses 64 and 64' are arranged such that, when the maximum distance between the light L74*a* the light L74*h* on the lens surface 62' of the lens 64' (namely, the effective diameter of the lens surface 62', specifically, the diameter of a light passing region thereof in the main-scanning direction) is defined as D, and the distance between a imaging point FP74*a* of the light L74*a* and a imaging point FP74*h* of light L74*h* (namely, the width of an image (light-emitting element group image) formed by the light-emitting element group 71) is defined as H, a relation of H>0.5D is satisfied. In the present specification, the imaging point refers to a position at which the spot size (cross-sectional width) of light becomes the smallest by the imaging function.

Furthermore, the lenses 64 and 64' are arranged such that the light L74*d* and the light L74*h* do not overlap with each other on the lens surface 62', and the light L74*d* and the light L74*h* do not overlap with each other on the lens surface 62'.

Furthermore, as illustrated in the drawing, the lens 64 is arranged such that, when an angle (angle of view) between the principal ray ML74*a* of the light L74*a* emitted from the light-emitting element 74*a* and the optical axis 601 is defined as ω, an image-side aperture angle of the light L74*a* is defined as μ, the distance between the diaphragm 82 and the lens surface 62' of the lens 64' is defined as L1, and the distance between the lens surface 62' and the image (the light receiving surface 111) of the light-emitting element group 71 is defined as L2, a relation of L1·tan ω>2·L2·tan μ is satisfied.

Here, the "principal ray ML74*a*" refers to a ray passing the center O of the diaphragm 82 (opening 821) among the light L74*a* emitted from the light-emitting element 74*a*. Therefore, the principal ray ML74*a* is approximately identical to a line that connects the centers of the light-emitting element 74*a* and the diaphragm 82. Although the light-emitting element 74*a* was described as a representative example, the same relationships are satisfied for other light-emitting elements 74*b* to 74*h*.

FIG. 7 is a cross-sectional view taken along the main-scanning direction so as to include the optical axis 601, illustrating the light L74*d* and light L74*c*, respectively, emitted from two light-emitting elements 74*d* and 74*c* that are adjacent to each other in the main-scanning direction. As illustrated in the drawing, the lens 64' is arranged such that the light L74*d* and the light L74*c* do not overlap with each other on the lens surface 62' of the lens 64' (namely, they pass through different regions on the lens surface 62'). Although in FIG. 7, the light-emitting elements 74*d* and 74*c* are exemplified as examples of the two light-emitting elements that are adjacent to each other in the main-scanning direction, the same statement can be applied to other light-emitting elements (namely, the light-emitting elements 74*a* and 74*b*, the light-emitting elements 74*b* and 74*c*, the light-emitting elements 74*d* and 74*e*, the light-emitting elements 74*e* and 74*f*, the light-emitting elements 74*f* and 74*g*, and the light-emitting elements 74*g* and 74*h*). That is to say, in the present embodiment, the lens 64' is arranged such that the light L74*a* to L74*h* do not overlap with each other on the lens surface 62' thereof.

In this manner, when the lenses 64 and 64' are arranged such that the relation of H>0.5D is satisfied, and the light L74*a* to L74*h* do not overlap with each other on the lens surface 62' of the lens 64', it is possible to control the refractive power of the lens surface 62' for each region through which the light L74*a* to L74*h* pass (that is to say, it is possible freely to set the positions of the imaging Points of the light L74*a* to L74*h* in the optical axis direction).

Therefore, as illustrated in FIG. 8, it is possible to make sure that the positions of the imaging points FP74*a* to FP74*h* of the light L74*a* to L74*h* from the light-emitting elements 74*a* to 74*h* having different angles of view are located at substantially the same positions in the optical axis direction. Accordingly, it is possible to suppress the unevenness in the spot size on the light receiving surface 111 due to an image-surface curvature low between the light-emitting elements 74*a* to 74*h* having different angles of view. As a result, it is possible to form a high-quality latent image in which the concentration unevenness is suppressed.

As described above, by arranging the lens 64 so as to satisfy the relation of $L1 \cdot \tan \omega > 2 \cdot L2 \cdot \tan \mu$, it is possible to arrange the lens 64' so that the light L74*a* to L74*h* do not overlap with each other on the lens surface 62' in a relatively simple manner.

Furthermore, by arranging the diaphragm 82 on a plane that contains an object-side focal point of the lens surface 62' (namely, a focal point on the side of the light-emitting element group 71), it is possible to arrange the lens 64' so that the light L74*a* to L74*h* do not overlap with each other on the lens surface 62' in a relatively simple manner.

Although in the present embodiment, the lenses 64 and 64' are arranged such that the light L74*a* to L74*h* do not overlap with each other on the lens surface 62', the lenses 64 and 64' may be arranged such that at least the light L74*d* (light from the light-emitting element that is located the furthest from the optical axis) and the light L74*h* (light from the light-emitting element that is located the closest to the optical axis) do not overlap with each other on the lens surface 62'.

Next, an operation of the line head 13, that is, an example of light-emitting timing of each light-emitting element 74 will be described with reference to FIGS. 9 to 14. Since the operations of the respective light-emitting element group columns are the same, an operation of the light-emitting element group column (light-emitting element groups 71*a* to 71*c*) located at the first column will be described as a representative example. In addition, as described above, the numbers 1 to 8 are given to the eight light-emitting elements 74 belonging to the light-emitting element group 71*a*, respectively. Similarly, the numbers 9 to 16 are given to the eight light-emitting elements 74 belonging to the light-emitting element group 71*b*, respectively. Similarly, the numbers 17 to 24 are given to the eight light-emitting elements 74 belonging to the light-emitting element group 71*c*, respectively. Moreover, in the following description, each number given to the light-emitting element 74 corresponds to each number given to a spot (latent image) SP.

When the line head 13 operates, the photosensitive drum 11 rotates at a predetermined constant circumferential speed.

Figure 9:
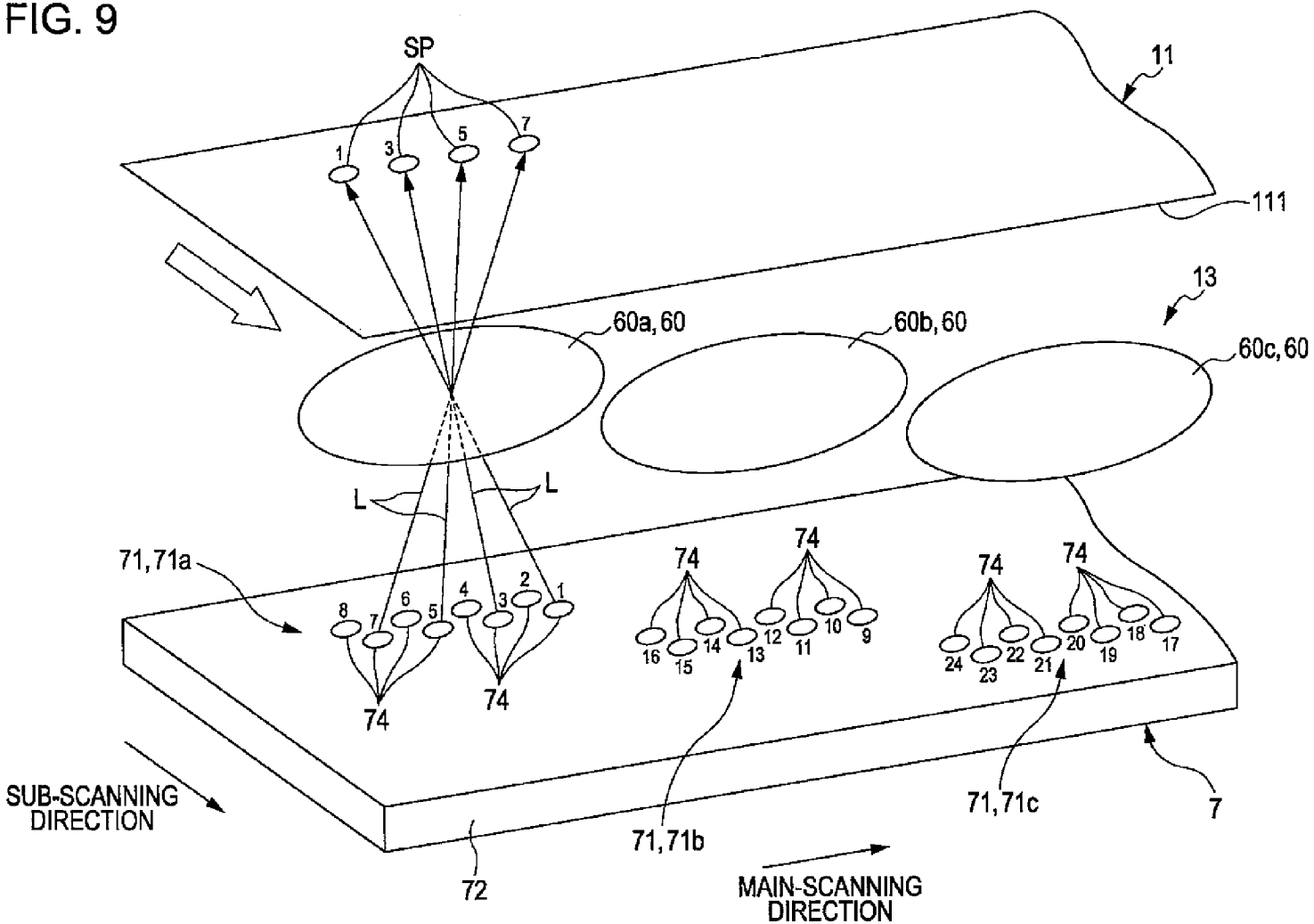
FIG. 9 is a perspective view schematically illustrating an operation state over time in the line head illustrated in FIG. 2.

First, as illustrated in FIG. 9, the light-emitting, elements 74 corresponding to the numbers 1, 3, 5, and 7 are simultaneously caused to emit light for a predetermined period (instantaneously). By emission of the light-emitting elements 74, four spots SP corresponding to the light-emitting elements 74 are formed on the light receiving surface 111 of the photosensitive drum 11. Each spot SP has a very small area.

The four spots SP are formed at the opposite positions of the light-emitting elements 74 corresponding to the numbers 1, 3, 5, and 7 with respect to the lens 64*a*, respectively.

In other words, the spot SP with the number 1 corresponding to the light-emitting element 74 with the number 1 that is located at the rightmost side in FIG. 9 is positioned at the leftmost side in FIG. 9. The spot SP with the number 3 is positioned at the right side of the spot SP with the number 1 in the main-scanning direction so as to be adjacent to the spot SP with the number 1 with a gap therebetween. The spot SP with the number 5 is positioned at the right side of the spot SP with the number 3 in the main-scanning direction so as to be adjacent to the spot SP with the number 3 with a gap therebetween. The spot SP with the number 7 is positioned at the right side of the spot SP with the number 5 in the main-scanning direction so as to be adjacent to the spot SP with the number 5 with a gap therebetween.

Figure 10:
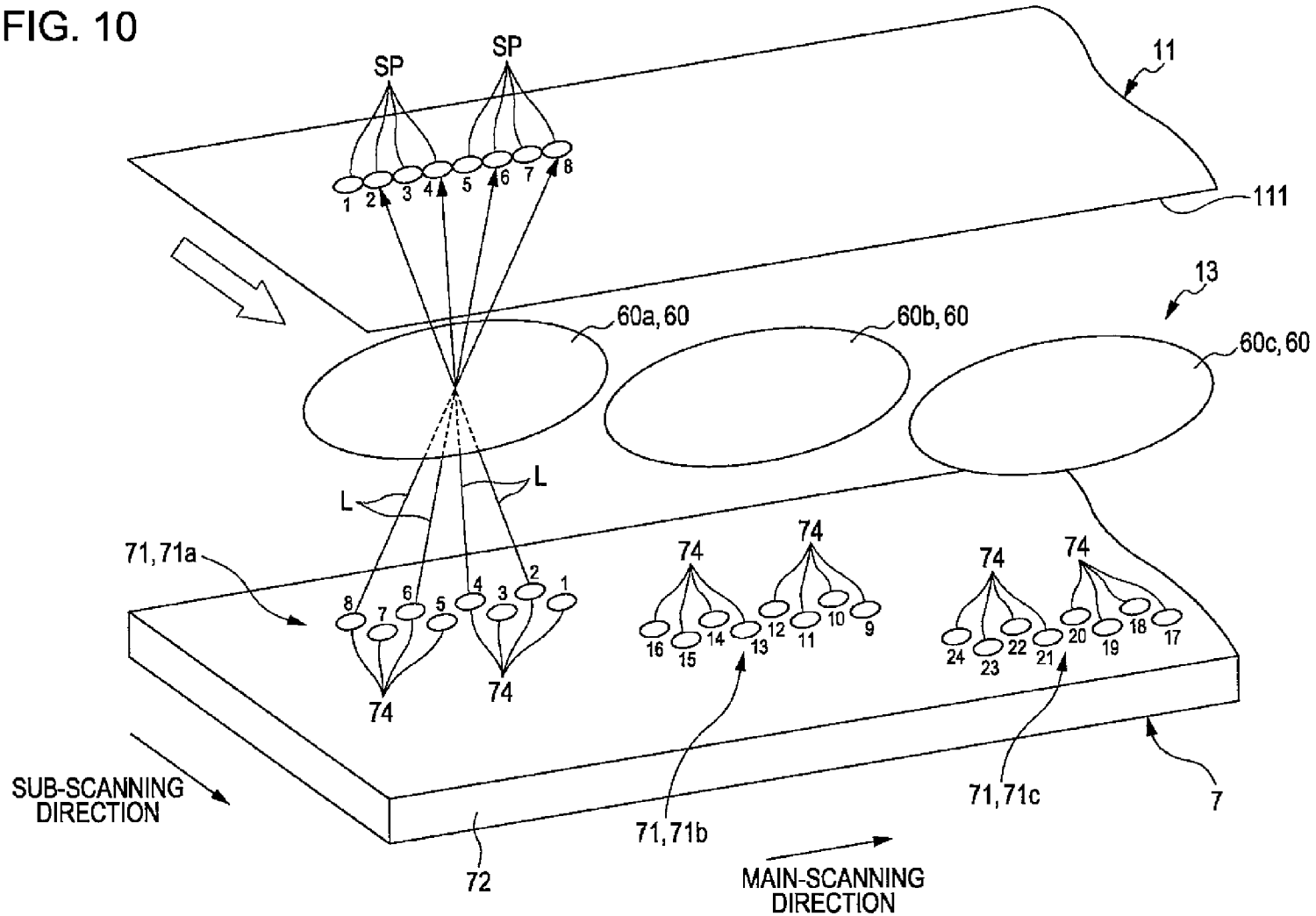
FIG. 10 is a perspective view schematically illustrating an operation state over time in the line head illustrated in FIG. 2.

Then, the light-emitting elements 74 corresponding to the numbers 2, 4, 6, and 8 are simultaneously caused to emit light for a predetermined period (instantaneously) in synchronization (conjunction) with rotation of the photosensitive drum 11 (see FIG. 10). By emission of the light-emitting elements 74, four spots SP corresponding to the light-emitting elements 74 are formed on the light receiving surface 111 of the photosensitive drum 11.

At that time, since the spots SP corresponding to the numbers 1, 3, 5, and 7 are moved with the rotation of the photosensitive drum 11, the four spots SP corresponding to the numbers 2, 4, 6, and 8 are formed so as to bury the respective spaces between the spots SP corresponding to the numbers 1, 3, 5, and 7. In this way, the spots SP corresponding to the numbers 1 to 8 are arranged in a straight line shape along the main-scanning direction in order from the left side in FIG. 10.

Figure 11:
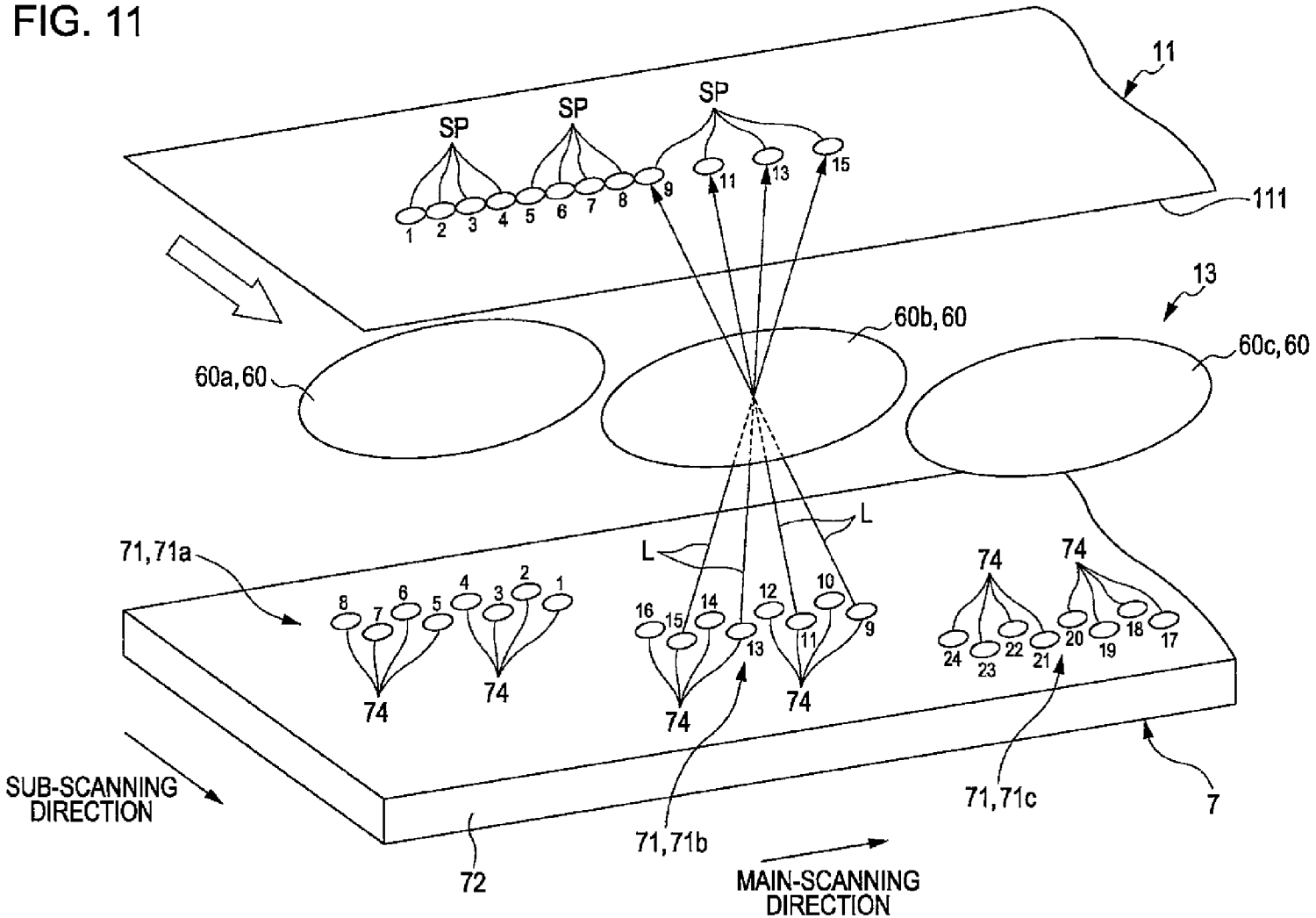
FIG. 11 is a perspective view schematically illustrating an operation state over time in the line head illustrated in FIG. 2.

Then, the light-emitting elements 74 corresponding to the numbers 9, 11, 13, and 15 are simultaneously caused to emit light for a predetermined period (instantaneously) in synchronization with rotation of the photosensitive drum 11 (see FIG. 11). By emission of the light-emitting elements 74, four spots SP corresponding to the light-emitting elements 74 are formed on the light receiving surface 111 of the photosensitive drum 11.

These four spots SP are formed at the right side of the spot SP with the number 8 in the main-scanning direction. The spot SP with the number 9 is positioned near the right side of the spot SP with the number 8 in the main-scanning direction so as to be adjacent to the spot SP with the number 8. The spot SP with the number 11 is positioned at the right side of the spot SP with the number 9 in the main-scanning direction so as to be adjacent to the spot SP with the number 9 with a gap therebetween. The spot SP with the number 13 is positioned at the right side of the spot SP with the number 11 in the main-scanning direction so as to be adjacent to the spot SP with the number 11 with a gap therebetween. The spot SP with the number 15 is positioned at the right side of the spot SP with the number 13 in the main-scanning direction so as to be adjacent to the spot SP with the number 13 with a gap therebetween.

Figure 12:
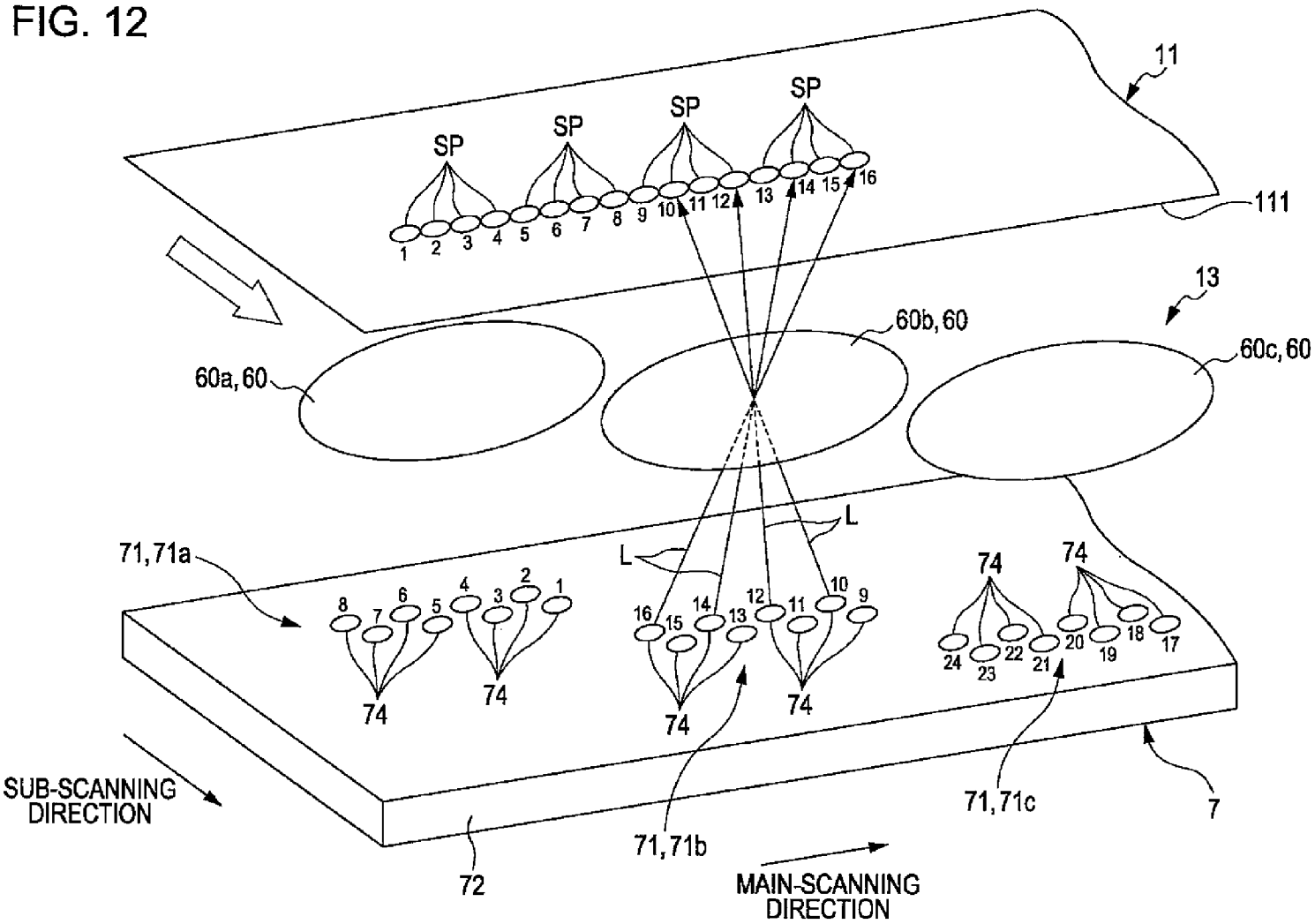
FIG. 12 is a perspective view schematically illustrating an operation state over time in the line head illustrated in FIG. 2.

Then, in the same manner as described above, the light-emitting elements 74 corresponding to the numbers 10, 12, 14, and 16 are simultaneously caused to emit light for a predetermined period (instantaneously) (see FIG. 12). By emission of the light-emitting elements 74, four spots SP corresponding to the light-emitting elements 74 are formed on the light receiving surface 111 of the photosensitive drum 11. Thus, the spots SP corresponding to the numbers 1 to 16 are arranged in a straight line shape along the main-scanning direction in order from the left side in FIG. 12.

Figure 13:
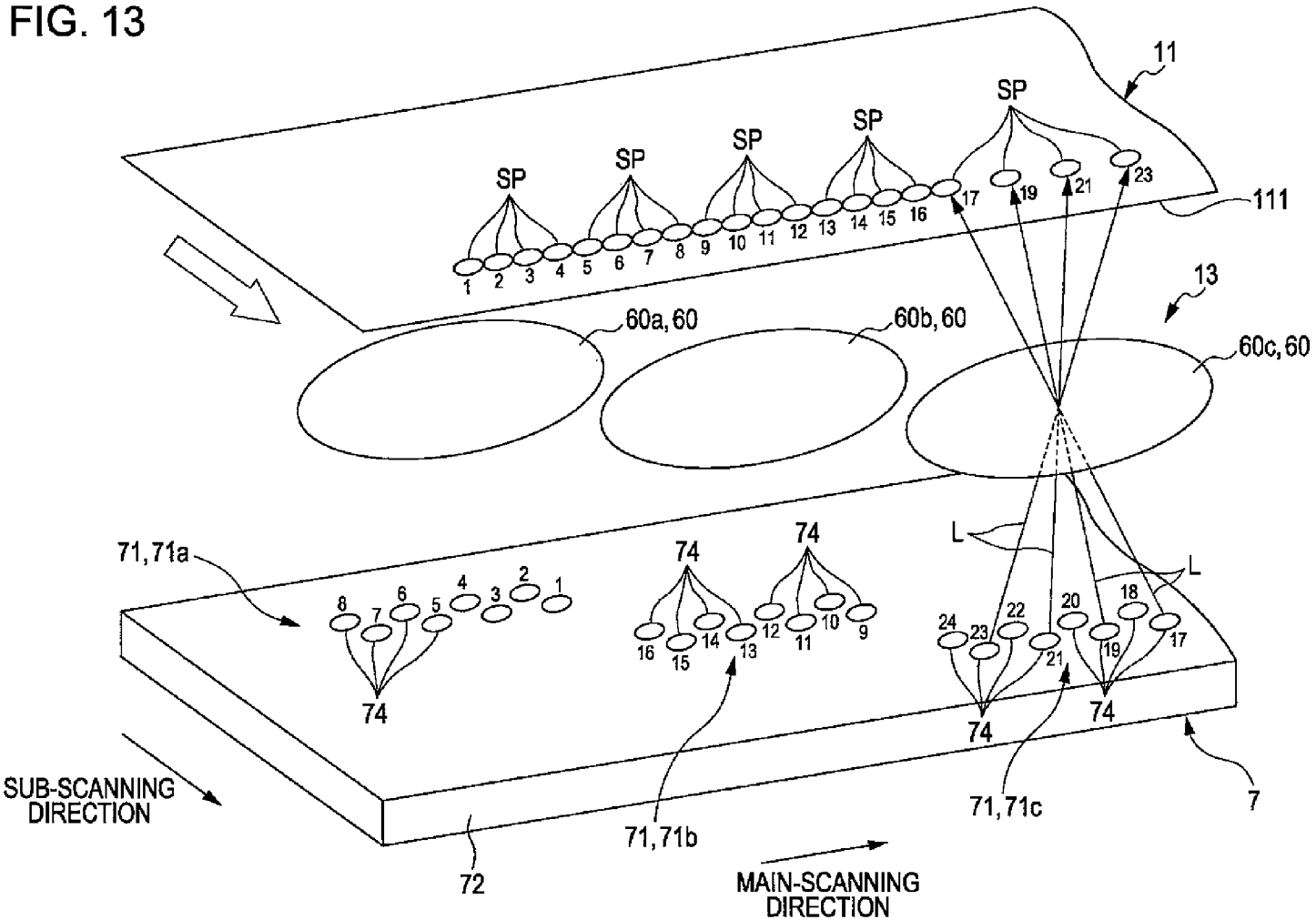
FIG. 13 is a perspective view schematically illustrating an operation state over time in the line head illustrated in FIG. 2.

Then, in the same manner as described above, the light-emitting elements 74 corresponding to the numbers 17, 19, 21, and 23 are simultaneously caused to emit light for a predetermined period (instantaneously) (see FIG. 13). By emission of the light-emitting elements 74, four spots SP corresponding to the light-emitting elements 74 are formed on the light receiving surface 111 of the photosensitive drum 11.

The spot SP with the number 17 is positioned near the right side of the spot SP with the number 16 in the main-scanning direction so as to be adjacent to the spot SP with the number 16. The spot SP with the number 19 is positioned at the right side of the spot SP with the number 17 in the main-scanning direction so as to be adjacent to the spot SP with the number 17 with a gap therebetween. The spot SP with the number 21 is positioned at the right side of the spot SP with the number 19 in the main-scanning direction so as to be adjacent to the spot SP with the number 19 with a gap therebetween. The spot SP with the number 23 is positioned at the right side of the spot SP with the number 21 in the main-scanning direction so as to be adjacent to the spot SP with the number 21 with a gap therebetween.

Figure 14:
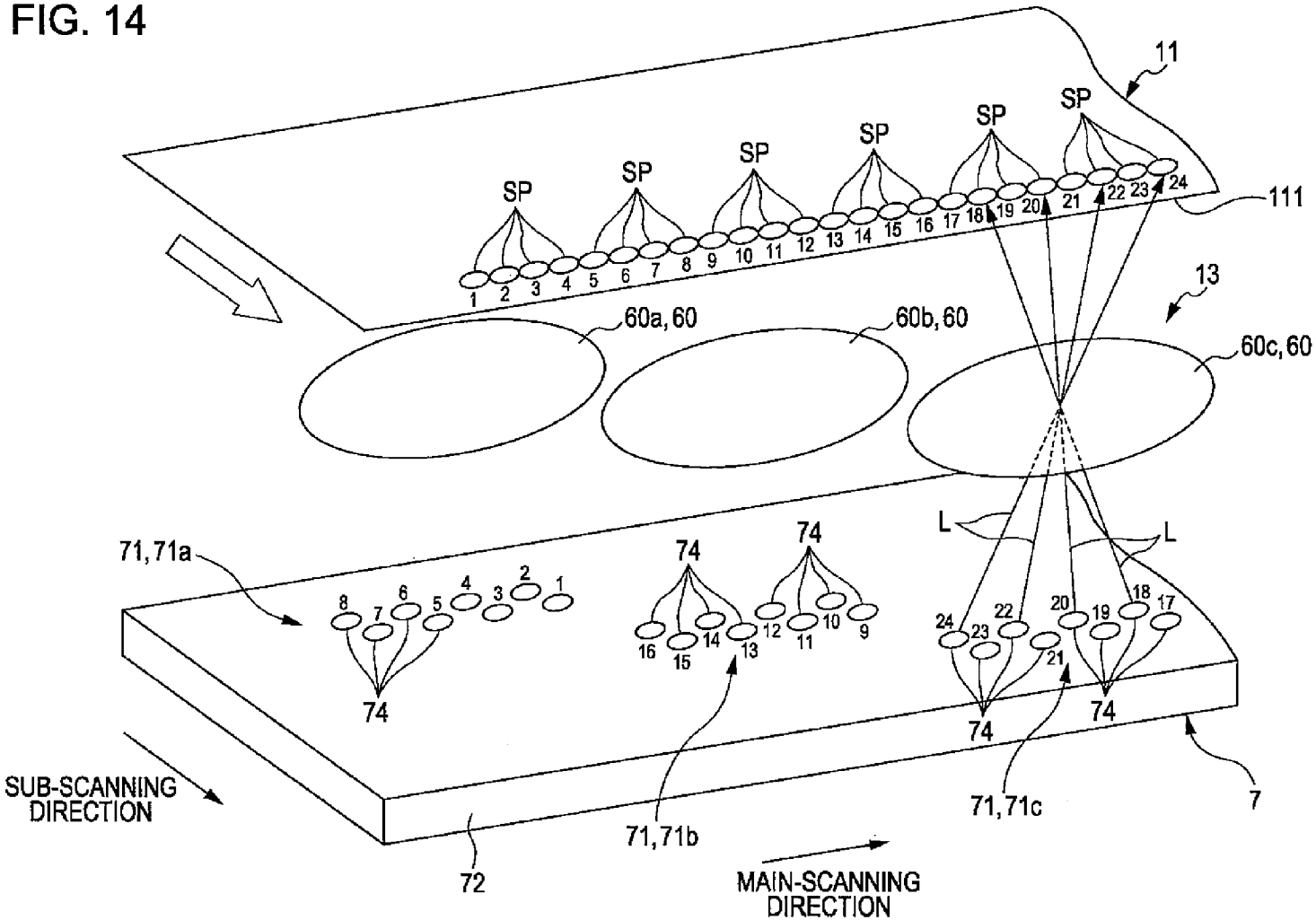
FIG. 14 is a perspective view schematically illustrating an operation state over time in the line head illustrated in FIG. 2.

Then, in the same manner as described above, the light-emitting elements 74 corresponding to the numbers 18, 20, 22, and 24 are simultaneously caused to emit light for a predetermined period (instantaneously) (see FIG. 14). By emission of the light-emitting elements 74, four spots SP corresponding to the light-emitting elements 74 are formed on the light receiving surface 111 of the photosensitive drum 11. Thus, the spots SP corresponding to the numbers 1 to 24 are arranged in a straight line shape along the main-scanning direction in order from the left side in FIG. 14.

Thus, in the line head 13, the light-emitting elements 74 located in two light-emitting element rows belonging to one light-emitting element group 71 are operated so that the light-emitting timings thereof are offset. Furthermore, the light-emitting element groups 71 located in one light-emitting element group column are operated so that the light-emitting timings thereof are offset.

Furthermore, as described above, the plurality of light-emitting element groups 71 are arranged in high density. Even in one light-emitting element group 71, the plurality of light-emitting elements 74 belonging thereto are arranged in high density.

Having described the line head and the image forming apparatus according to the embodiments of the invention, the invention is not limited thereto. Each of the components provided in the line head and the image forming apparatus can be replaced with a component having an arbitrary configuration capable of realizing the same function. In addition, an arbitrary structure may be added.

Furthermore, in the lens arrays, a plurality of lenses is not limited to being arranged in a matrix of three rows by n columns. For example, a plurality of lenses in each of the lens arrays may be arranged in a matrix of two rows by n columns, four rows by n columns, and the like.

Furthermore, in the lens array, focal distances of at least two lens pairs of the lenses belonging to one column are different. As a method of changing the focal distance, a method of changing the radii of curvature (shape) of the convex surfaces of lens pairs may be used.

Furthermore, a lens protection member is not limited to a glass material, but may be formed of any material as long as it is a substantially transparent material.

Furthermore, although in the embodiment described above, it has been described that there are many light-emitting elements corresponding to one lens, the invention is not limited thereto. For example, one light-emitting element may be provided corresponding to one lens.

In addition, the number of light-emitting elements that form one light-emitting element group is not limited to eight. For example, the number of light-emitting elements that form one light-emitting element group may be two, three, four, five, six, seven, nine, or more.

Furthermore, in each light-emitting element group, light-emitting elements are not limited to being arranged in a matrix form. For example, the light-emitting elements may be arranged in an arbitrary form that is different from the matrix form. For example, when one light-emitting element group is configured to include three light-emitting elements, the three light-emitting elements may be arranged such that lines connecting the centers of the three light-emitting elements make a triangle.

In addition, each light-emitting element is not limited to an OLED element. For example, each light-emitting element may be configured by a light-emitting diode (LED).

EXAMPLES

Hereinafter, specific examples of the invention will be described.

1. Manufacturing of Image Forming Apparatus

Example 1

Production of Lens 64

A resin layer formed of a resin material was formed on one surface of a flat plate-like glass substrate formed of a glass material, and a lens surface 62 was formed on a surface of the resin layer opposite the glass substrate, whereby a lens 64 having a circular shape in a plan view thereof was produced. The surface shape of the lens surface 62 was defined by a definition formula by substituting the numerical values of Formula 1 above with CU=1/1.192209402496, K=−0.145298222185, A=−0.07856519854126, and B=−0.2398156584367.

Production of Lens 64'

A resin layer formed of a resin material was formed on one surface of a flat plate-like glass substrate formed of a glass material, and a lens surface 62' was formed on a surface of the resin layer opposite the glass substrate, whereby a lens 64' having a circular shape in a plan view thereof was produced. The surface shape of the lens surface 62' was defined by a definition formula by substituting the numerical values of Formula 2 above with CU=1/1.219034828545, K=−0.4285643222867, $C_{0,2}$=−0.0003762542359154, $C_{4,0}$=−0.08011245919592, $C_{2,2}$=−0.2100584158315, $C_{0,4}$=−0.08482513059152, $C_{6,0}$=−0.004602164015259, $C_{4,2}$=0.08256575748808, $C_{2,4}$=−0.1310328532725, $C_{0,6}$=0.2492044229571.

Production of Line Head

The lenses 64 and 64' having the described shape were combined together, and a line head 13 as illustrated in FIG. 15 was formed. In FIG. 15, one optical system is illustrated as a representative example, and other optical systems are not illustrated. FIG. 15 is a cross-sectional view of the optical system 60, illustrating a cross section taken along the main-scanning direction so as to include the optical axis 601 of the optical system 60.

As illustrated in FIG. 15, the line head 13 has the light-emitting element array 7 having the light-emitting element group 71 (a plurality of light-emitting elements 74), the diaphragm 82, and the lenses 64 and 64' (the optical system 60) that are arranged in that order from the left side.

In the present example, the light-emitting element group 71 includes three or more light-emitting elements 74 including light-emitting elements 741, 742, and 743. Among these three or more light-emitting elements 74, the light-emitting element 741 was arranged to be located on the optical axis 601 (namely, the position closest to the optical axis 601), and the light-emitting elements 742 and 743 were arranged to be located on opposite sides with respect to the light-emitting element 741 and the furthest from the optical axis 601. The diameter of each light-emitting element 74 was 40 μm.

The wavelength of light emitted from each light-emitting element 74 was 690 nm (hereinafter, this wavelength will be referred to as "reference wavelength"). Furthermore, the object-side numerical aperture of the optical system 60 was 0.100, the effective diameter of the lens surface 62' in the main-scanning direction was 1.40 mm, and the total width w (the length in the main-scanning direction) of the light-emitting element group 71 was 1.00 mm.

The line head 13 was mounted on the image forming apparatus illustrated in FIG. 1 together with the photosensitive drum 11. At this time, the photosensitive drum 11 was arranged so that the light receiving surface 111 thereof became identical to the imaging surface of the line head 13.

As illustrated in FIG. 15, respective surfaces S1 to S10 have a configuration as shown in Table 1, in which a surface S1 is the left-side surface of the light-emitting element array 7 (a surface having the light-emitting element group 71 thereon), a surface 52 is the right-side surface of the light-emitting element array 7, a surface S3 is the surface of the diaphragm 82, a surface S4 is the lens surface 62 of the lens 64, a surface S5 is a boundary surface of the glass substrate and the resin layer of the lens 64, a surface S6 is a flat surface (the right-side surface) of the lens 64, a surface S7 is the lens surface 62' of the lens 64', a surface S8 is a boundary portion of the glass substrate and the resin layer of the lens 64', a surface S9 is a flat surface (the right-side surface) of the lens 64', and a surface 510 is the light receiving surface 111 of the photosensitive drum 11.

Moreover, respective surface spacing values d1 to d9 have values (in the unit of mm) as shown in FIG. 1, in which d1 is a surface spacing (distance) between the surface S1 and the surface S2, d2 is a surface spacing between the surface S2 and the surface S3, d3 is a surface spacing between the surface 53 and the surface 54, d4 is a surface spacing between the surface S4 and the surface S5, d5 is a surface spacing between the surface S5 and the surface 56, d6 is a surface spacing between the surface S6 and the surface S7, d7 is a surface spacing between the surface S7 and the surface S8, d8 is a surface spacing between the surface S8 and the surface S9, and d9 is a surface spacing between the surface S9 and the surface S10.

TABLE 1

| Surface number | Description | Curvature at the center of main-cross section | Surface spacing | Refractive index at reference wavelength |
|---|---|---|---|---|
| S1 | Light source plane | r1 = ∞ | d1 = 0.55 | n1 = 1.499857 |
| S2 | Emission surface of glass substrate | r2 = ∞ | d2 = 1.6810 | |
| S3 | Aperture diaphragm | r3 = ∞ | d3 = 0.2071 | |
| S4 | Incidence surface of resin portion | r4 = (separately described) | d4 = 0.3 | n4 = 1.530000 |

TABLE 1-continued

| Surface number | Description | Curvature at the center of main-cross section | Surface spacing | Refractive index at reference wavelength |
|---|---|---|---|---|
| S5 | Resin-glass boundary surface | r5 = ∞ | d5 = 0.5 | n5 = 1.541000 |
| S6 | Emission surface of lens | r6 = ∞ | d6 = 1.4187 | |
| S7 | Incidence surface of lens resin portion | r7 = (separately described) | d7 = 0.3 | n7 = 1.530000 |
| S8 | Resin-glass boundary surface | r8 = ∞ | d8 = 0.5 | n8 = 1.541000 |
| S9 | Emission surface of lens | r9 = ∞ | d9 = 1.80 | |
| S10 | Image surface | r10 = ∞ | | |

In the line head 13, L1·tan ω=0.5664 and 2·L2·tan μ=0.5219, and therefore, a relation of L1·tan ω>2·L2·tan μ is satisfied.

Comparative Example 1

An optical system of Comparative Example 1 is the same as that of Example 1, except that a lens 64" was used in lieu of the lens 64'.

Production of Lens 64"

A resin layer formed of a resin material was formed on one surface of a flat plate-like glass substrate formed of a glass material, and a convex surface (lens surface) 62" was formed on a surface of the resin layer opposite the glass substrate, whereby the lens 64" was formed. The surface shape of the lens surface 62" was defined by a definition formula by substituting the numerical values of Formula 1 above with CU=1/1.166313177417, K=−0.8956866874817, A=−0.07206833883164, B=0.078025192894, C=−0.06501318914546.

2. Evaluation

The optical system of the example obtained in the above-described manner had an image-surface curvature as illustrated in FIG. 16. Moreover, the optical system of the comparative example had an image-surface curvature as illustrated in FIG. 17. In FIGS. 16 and 17, the horizontal axis represents the image-surface curvature, which represents the offsets of the imaging points, and is defined such that, when the 0 (reference) point of the horizontal axis corresponds to an image-surface curvature in the vicinity of the optical axis, the left side is the light source side and the right side is the image side. Moreover, the image surface (imaging point) on the meridional cross section (tangential) is illustrated by a solid line, and the image surface (imaging point) on the spherical cross section (sagittal) is illustrated by a broken line.

Figure 18:
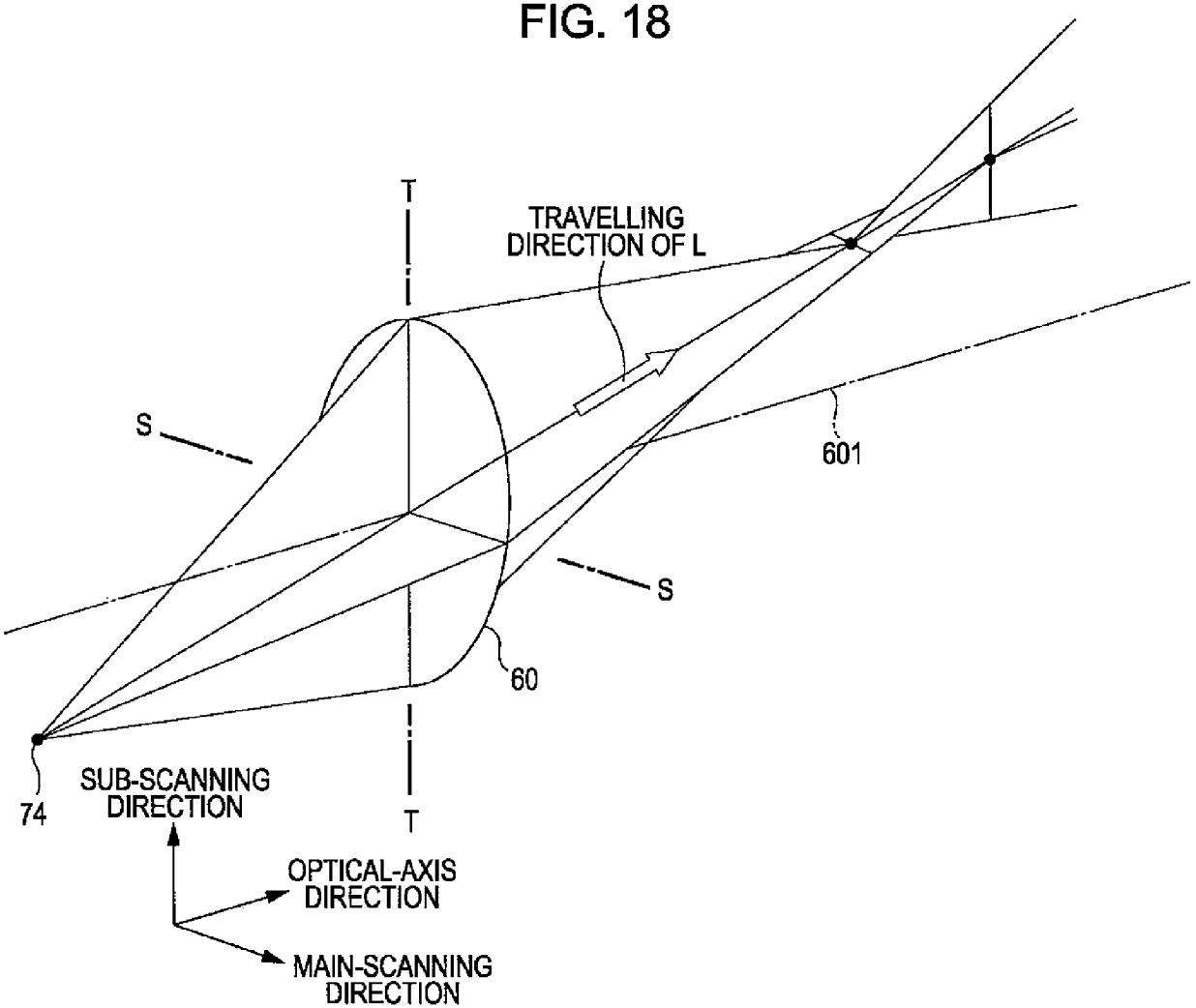
FIG. 18 is a view for describing imaging points in the optical system illustrated in FIG. 16.

Here, as illustrated in FIG. 18, the meridional cross section is a plane (T-T cross section) including an emission point (object point) of a light-emitting element (for example, the light-emitting element 741) and the optical axis 601. The spherical cross section is a plane (S-S cross section) that includes the principal ray of light emitted from the light-emitting element 74 and that is orthogonal to the T-T cross section (meridional cross section).

As is obvious from FIGS. 16 and 17, the line head (optical system) of the example according to the invention was better able to suppress the image-surface curvature than the line head of the comparative example. That is to say, the line head of the example was better able to suppress a variation in the spot size on the light receiving surface due to the image-surface curvature low than the line head of the comparative example.

Moreover, the line heads of the example and the comparative example were mounted on the image forming apparatuses as illustrated in FIG. 1, and toner images were formed using the respective image forming apparatuses. With the image forming apparatuses of the example, it was possible to obtain higher-quality toner images in which concentration unevenness was not observed, compared to the image forming apparatus of the comparative example. The entire disclosure of Japanese Patent Application No. 2009-039987, filed on Feb. 23, 2009 is expressly incorporated by reference herein.

What is claimed is:

1. A line head comprising:

a first light-emitting element, a second light-emitting element, and a third light-emitting element that are arranged in a first direction; and an optical system that forms an image by light emitted from the first light-emitting element, an image by light emitted from the second light-emitting element, and an image by light emitted from the third light-emitting element on an imaging surface to form an image by light emitted from the first light-emitting element, an image by light emitted from the second light-emitting element, and an image by light emitted from the third light-emitting element, wherein the first light-emitting element is arranged between the second light-emitting element and the third light-emitting element in the first direction;

the optical system has a first lens surface that has refractive power and is arranged so as to satisfy the relationship below;

light emitted from the first light-emitting element and light emitted from the second light-emitting element do not overlap with each other on a cross section of the first lens surface taken along the first direction so as to include an optical axis of the optical system;

$$H>0.5D,$$

where H is a distance in the first direction between the geometrical center of the image of the second light-emitting element and the geometrical center of the image of the third light-emitting element, imaged by the optical system; and D is the maximum width in the first direction of a region of the first lens surface through which light emitted from the second light-emitting element and the third light-emitting element pass;

an aperture diaphragm is provided between the second light-emitting element and the optical system; and the lens surface is arranged so as to satisfy a relation of $L1 \cdot \tan \omega > 2 \cdot L2 \cdot \tan \mu$, where $\omega$ is an angle in the first direction between a principal ray of light emitted from the second light-emitting element and the optical axis;

$\mu$ is an image-side aperture angle (half-angle) of the optical system;

L1 is a distance between the aperture diaphragm and the first lens surface; and L2 is a distance between the first lens surface and the imaging surface.

2. The line head according to claim 1, wherein:

light emitted from four or more light-emitting elements that include the first light-emitting element, the second light-emitting element, and the third light-emitting element and that are arranged in the first direction is imaged on the imaging surface by the optical system;

the first light-emitting element is located at the position closest to the optical axis among the four or more light-emitting elements;

the second light-emitting element is located on one side in the first direction at the position furthest from the optical axis among the four or more light-emitting elements; and the third light-emitting element is located on the other side of the second light-emitting element in the first direction at the position furthest from the optical axis among the four or more light-emitting elements.

3. The line head according to claim 1, wherein:

the optical system has two or more lens surfaces having refractive power including the first lens surface; and the first lens surface is positioned the closest to an image side among the two or more lens surfaces having refractive power.

4. The line head according to claim 1, wherein the aperture diaphragm is provided on a front-side focal plane of the optical system.

5. The line head according to claim 2, wherein light emitted from two light-emitting elements that are arranged adjacent to each other in the first direction among the four or more light-emitting elements do not overlap with each other on across section of the first lens surface taken along the first direction so as to include the optical axis.

6. An image forming apparatus comprising:

a latent image carrier on which a latent image is formed; and a line head that performs exposure on the latent image carrier so as to form the latent image, wherein the line head comprises:

a first light-emitting element, a second light-emitting element, and a third light-emitting element that are arranged in a first direction; and an optical system that forms a latent image by light emitted from the first light-emitting element, a latent image by light emitted from the second light-emitting element, and a latent image by light emitted from the third light-emitting element on the latent image carrier;

the first light-emitting element is arranged between the second light-emitting element and the third light-emitting element in the first direction;

the optical system has a first lens surface that has refractive power and is arranged so as to satisfy the relationship below;

light emitted from the first light-emitting element and light emitted from the second light-emitting element do not overlap with each other on a cross section of the first lens surface taken along the first direction so as to include an optical axis of the optical system;

$$H>0.5D,$$

where H is a distance in the first direction between the geometrical center of the latent image formed by the second light-emitting element and the geometrical center of the latent image formed by the third light-emitting element, imaged by the optical system; and D is the maximum width in the first direction of a region of the first lens surface through which light emitted from the second light-emitting element and the third light-emitting element pass;

an aperture diaphragm is provided between the second light-emitting element and the optical system; and the lens surface is arranged so as to satisfy a relation of $L1 \cdot \tan \omega > 2 \cdot \tan \mu$, where $\omega$ is an angle in the first direction between a principal ray of light emitted from the second light-emitting element and the optical axis;

$\mu$ is an image-side aperture angle (half-angle) of the optical system;

L1 is a distance between the aperture diaphragm and the first lens surface; and L2 is a distance between the first lens surface and the imaging surface.

* * * * *